US010477310B2

(12) United States Patent
Salehin et al.

(10) Patent No.: US 10,477,310 B2
(45) Date of Patent: Nov. 12, 2019

(54) AMBISONIC SIGNAL GENERATION FOR MICROPHONE ARRAYS

(71) Applicant: QUALCOMM Incorporated, San Diego, CA (US)

(72) Inventors: S M Akramus Salehin, San Diego, CA (US); Ricardo De Jesus Bernal Castillo, San Diego, CA (US); Michael Ericson, San Diego, CA (US); Ferdinando Olivieri, San Diego, CA (US); Nils Gunther Peters, San Diego, CA (US); Dipanjan Sen, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 15/836,660

(22) Filed: Dec. 8, 2017

(65) Prior Publication Data

US 2019/0069083 A1 Feb. 28, 2019

Related U.S. Application Data

(60) Provisional application No. 62/549,917, filed on Aug. 24, 2017.

(51) Int. Cl.

| | |
|---|---|
| ***H04R 3/00*** | (2006.01) |
| ***H04S 7/00*** | (2006.01) |
| *H04R 1/40* | (2006.01) |

(52) U.S. Cl.

CPC ..... *H04R 3/005* (2013.01); *H04S 7/30* (2013.01); *H04R 1/406* (2013.01); *H04R 2499/11* (2013.01); *H04S 7/304* (2013.01); *H04S 2400/11* (2013.01); *H04S 2400/15* (2013.01); *H04S 2420/11* (2013.01)

(58) Field of Classification Search

CPC .... H04R 3/005; H04R 1/406; H04R 2499/11; H04S 2400/15; H04S 7/30; H04S 2400/11; H04S 2420/11; H04S 7/304

USPC ..... 381/92

See application file for complete search history.

(56) References Cited

U.S. PATENT DOCUMENTS

| | | | | |
|---|---|---|---|---|
| 8,654,990 | B2 | 2/2014 | Faller | |
| 9,237,225 | B2 | 1/2016 | Garcia et al. | |
| 9,552,840 | B2 * | 1/2017 | Kim | G11B 20/00 |
| 9,578,439 | B2 | 2/2017 | Kim et al. | |
| 2014/0270219 | A1 | 9/2014 | Yu et al. | |
| 2016/0227337 | A1 | 8/2016 | Goodwin et al. | |

FOREIGN PATENT DOCUMENTS

| | | | |
|---|---|---|---|
| EP | 1737271 | A1 | 12/2006 |

* cited by examiner

*Primary Examiner* — Paul Kim

(74) *Attorney, Agent, or Firm* — Qualcomm Incorporated—Toler

(57) ABSTRACT

A method includes performing, at a processor, signal processing operations on signals captured by each microphone in a microphone array. The method also includes performing a first directivity adjustment by applying a first set of multiplicative factors to the signals to generate a first set of ambisonic signals. The first set of multiplicative factors is determined based on a position of each microphone in the microphone array, an orientation of each microphone in the microphone array, or both.

30 Claims, 14 Drawing Sheets

Back of Mobile Device

Front of Mobile Device

AMBISONIC SIGNAL GENERATION FOR MICROPHONE ARRAYS

I. CROSS REFERENCE TO RELATED APPLICATIONS

The present application claims the benefit of U.S. Provisional Patent Application No. 62/549,917, entitled "AMBISONIC SIGNAL GENERATION FOR MICROPHONE ARRAYS," filed Aug. 24, 2017, which is expressly incorporated by reference herein in its entirety.

II. FIELD

The present disclosure is generally related to microphones.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A higher-order ambisonics (HOA) signal (often represented by a plurality of spherical harmonic coefficients (SHC) or other hierarchical elements) is a three-dimensional representation of a soundfield. The HOA signal, or SHC representation of the HOA signal, may represent the soundfield in a manner that is independent of local speaker geometry used to playback a multi-channel audio signal rendered from the HOA signal. The HOA signal may also facilitate backwards compatibility as the HOA signal may be rendered to multi-channel formats, such as a 5.1 audio channel format or a 7.1 audio channel format.

IV. SUMMARY

According to a particular implementation of the techniques disclosed herein, an apparatus includes a processor configured to perform signal processing operations on signals captured by each microphone in a microphone array. The processor is also configured to perform a first directivity adjustment by applying a first set of multiplicative factors to the signals to generate a first set of ambisonic signals. The first set of multiplicative factors is determined based on a position of each microphone in the microphone array, an orientation of each microphone in the microphone array, or both.

According to another particular implementation of the techniques disclosed herein, a method includes performing, at a processor, signal processing operations on signals captured by each microphone in a microphone array. The method also includes performing a first directivity adjustment by applying a first set of multiplicative factors to the signals to generate a first set of ambisonic signals. The first set of multiplicative factors is determined based on a position of each microphone in the microphone array, an orientation of each microphone in the microphone array, or both.

According to another particular implementation of the techniques disclosed herein, a non-transitory computer-readable medium includes instructions that, when executed by a processor, cause the processor to perform operations including performing signal processing operations on signals captured by each microphone in a microphone array. The operations also include performing a first directivity adjustment by applying a first set of multiplicative factors to the signals to generate a first set of ambisonic signals. The first set of multiplicative factors is determined based on a position of each microphone in the microphone array, an orientation of each microphone in the microphone array, or both.

According to another particular implementation of the techniques disclosed herein, an apparatus includes means for performing signal processing operations on signals captured by each microphone in a microphone array. The apparatus also includes means for performing a first directivity adjustment by applying a first set of multiplicative factors to the signals to generate a first set of ambisonic signals. The first set of multiplicative factors is determined based on a position of each microphone in the microphone array, an orientation of each microphone in the microphone array, or both.

According to another particular implementation of the techniques disclosed herein, an apparatus includes a microphone array including a first microphone, a second microphone, a third microphone, and a fourth microphone. At least two microphones associated with the microphone array are located on different two-dimensional planes. The apparatus also includes signal processing circuitry coupled to the microphone array. The signal processing circuitry is configured to perform signal processing operations on analog signals captured by each microphone of the microphone array to generate digital signals. The apparatus further includes a first directivity adjuster coupled to the signal processing circuitry. The first directivity adjuster is configured to apply a first set of multiplicative factors to the digital signals to generate a first set of ambisonic signals. The first set of multiplicative factors is determined based on a position of each microphone in the microphone array, an orientation of each microphone in the microphone array, or both. The apparatus also includes a second directivity adjuster coupled to the signal processing circuitry. The second directivity adjuster is configured to apply a second set of multiplicative factors to the digital signals to generate a second set of ambisonic signals. The second set of multiplicative factors is determined based on the position of each microphone in the microphone array, the orientation of each microphone in the microphone array, or both.

According to another particular implementation of the techniques disclosed herein, a method includes performing signal processing operations on analog signals captured by each microphone of a microphone array to generate digital signals. The microphone array includes a first microphone, a second microphone, a third microphone, and a fourth microphone. At least two microphones associated with the microphone array are located on different two-dimensional planes. The method also includes applying a first set of multiplicative factors to the digital signals to generate a first set of ambisonic signals. The first set of multiplicative factors is determined based on a position of each microphone in the microphone array, an orientation of each microphone in the microphone array, or both. The method also includes applying a second set of multiplicative factors to the digital signals to generate a second set of ambisonic signals. The second set of multiplicative factors is determined based on the position of each microphone in the microphone array, the orientation of each microphone in the microphone array, or both.

According to another particular implementation of the techniques disclosed herein, a non-transitory computer-readable medium includes instructions that, when executed by a processor, cause the processor to perform operations including performing signal processing operations on analog signals captured by each microphone of a microphone array to generate digital signals. The microphone array includes a first microphone, a second microphone, a third microphone, and a fourth microphone. At least two microphones associated with the microphone array are located on different two-dimensional planes. The operations also include applying a first set of multiplicative factors to the digital signals to generate a first set of ambisonic signals. The first set of multiplicative factors is determined based on a position of each microphone in the microphone array, an orientation of each microphone in the microphone array, or both. The operations also include applying a second set of multiplicative factors to the digital signals to generate a second set of ambisonic signals. The second set of multiplicative factors is determined based on the position of each microphone in the microphone array, the orientation of each microphone in the microphone array, or both.

According to another particular implementation of the techniques disclosed herein, an apparatus includes means for performing signal processing operations on analog signals captured by each microphone of a microphone array to generate digital signals. The microphone array includes a first microphone, a second microphone, a third microphone, and a fourth microphone. At least two microphones associated with the microphone array are located on different two-dimensional planes. The apparatus also includes means for applying a first set of multiplicative factors to the digital signals to generate a first set of ambisonic signals. The first set of multiplicative factors is determined based on a position of each microphone in the microphone array, an orientation of each microphone in the microphone array, or both. The apparatus also includes means for applying a second set of multiplicative factors to the digital signals to generate a second set of ambisonic signals. The second set of multiplicative factors is determined based on the position of each microphone in the microphone array, the orientation of each microphone in the microphone array, or both.

According to another particular implementation of the techniques disclosed herein, an apparatus includes a microphone array including a first microphone, a second microphone, a third microphone, and a fourth microphone. At least two microphones associated with the microphone array are located on different two-dimensional planes. The apparatus also includes a processor coupled to the microphone array. The processor is configured to determine position information for each microphone of the microphone array and to determine orientation information for each microphone of the microphone array. The processor is also configured to determine how many sets of multiplicative factors are to be applied to digital signals associated with microphones of the microphone array based on the position information and the orientation information. Each set of multiplicative factors is used to determine a processed set of ambisonic signals.

According to another particular implementation of the techniques disclosed herein, a method includes determining position information for each microphone of a microphone array. The microphone array includes a first microphone, a second microphone, a third microphone, and a fourth microphone. At least two microphones associated with the microphone array are located on different two-dimensional planes. The method also includes determining orientation information for each microphone of the microphone array. The method further includes determining how many sets of multiplicative factors are to be applied to digital signals associated with microphones of the microphone array based on the position information and the orientation information. Each set of multiplicative factors is used to determine a processed set of ambisonic signals.

According to another particular implementation of the techniques disclosed herein, a non-transitory computer-readable medium includes instructions that, when executed by a processor, cause the processor to perform operations including determining position information for each microphone of a microphone array. The microphone array includes a first microphone, a second microphone, a third microphone, and a fourth microphone. At least two microphones associated with the microphone array are located on different two-dimensional planes. The operations also include determining orientation information for each microphone of the microphone array. The operations also include determining how many sets of multiplicative factors are to be applied to digital signals associated with microphones of the microphone array based on the position information and the orientation information. Each set of multiplicative factors is used to determine a processed set of ambisonic signals.

According to another particular implementation of the techniques disclosed herein, an apparatus includes means for determining position information for each microphone of a microphone array. The microphone array includes a first microphone, a second microphone, a third microphone, and a fourth microphone. At least two microphones associated with the microphone array are located on different two-dimensional planes. The apparatus also includes means for determining orientation information for each microphone of the microphone array. The apparatus also includes means for determining how many sets of multiplicative factors are to be applied to digital signals associated with microphones of the microphone array based on the position information and the orientation information. Each set of multiplicative factors is used to determine a processed set of ambisonic signals.

Other implementations, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1A:
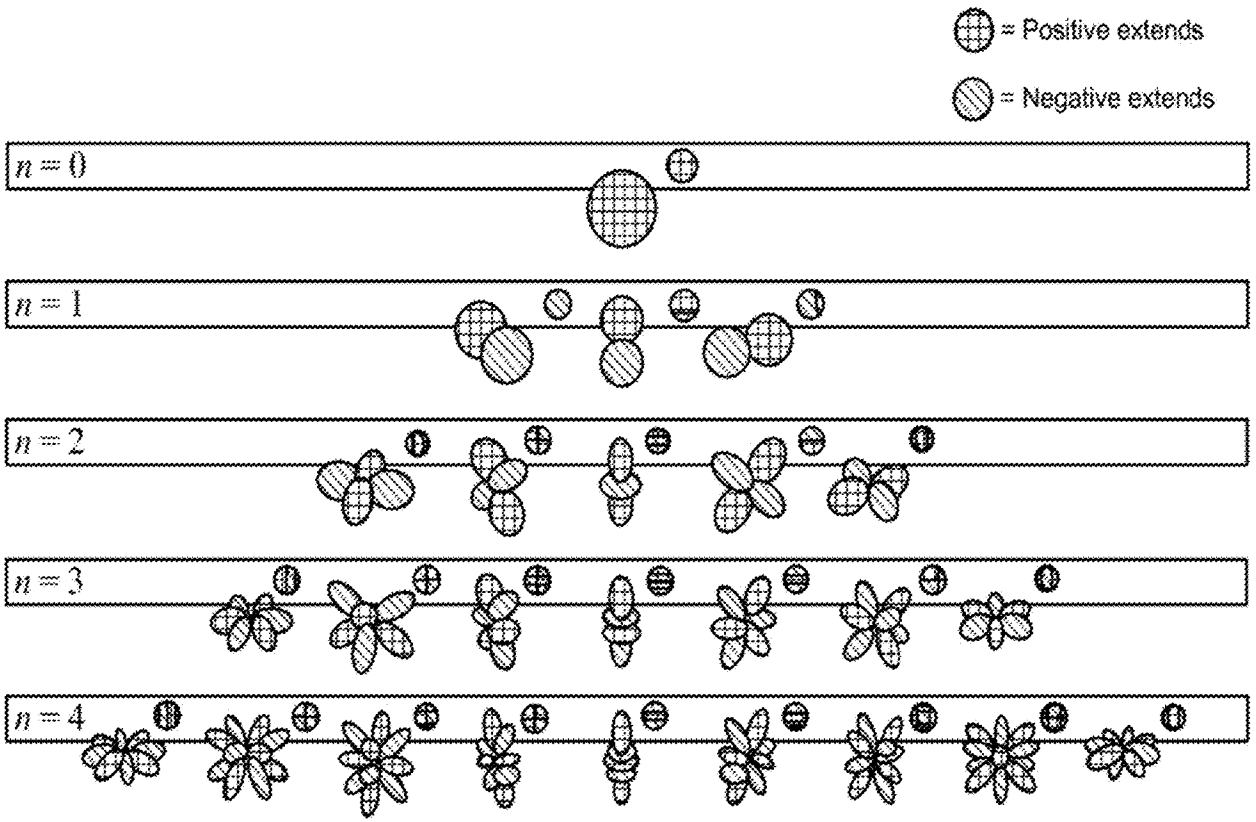
FIG. 1A is a diagram illustrating spherical harmonic basis functions of various orders and sub-orders.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprise," "comprises," and "comprising" may be used interchangeably with "include," "includes," or "including." Additionally, it will be understood that the term "wherein" may be used interchangeably with "where." As used herein, "exemplary" may indicate an example, an implementation, and/or an aspect, and should not be construed as limiting or as indicating a preference or a preferred implementation. As used herein, an ordinal term (e.g., "first, " "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "estimating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "estimating", "using", "selecting", "accessing", and "determining" may be used interchangeably. For example, "generating", "calculating", "estimating", or "determining" a parameter (or a signal) may refer to actively generating, estimating, calculating, or determining the parameter (or the signal) or may refer to using, selecting, or accessing the parameter (or signal) that is already generated, such as by another component or device.

In general, techniques are described for coding of higher-order ambisonics audio data. Higher-order ambisonics audio data may include at least one higher-order ambisonic (HOA) coefficient corresponding to a spherical harmonic basis function having an order greater than one.

The evolution of surround sound has made available many audio output formats for entertainment. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, and various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such a sound array includes 32 loudspeakers positioned at coordinates on the corners of a truncated icosahedron.

The input to a future Moving Picture Experts Group (MPEG) encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); or (iii) scene-based audio, which involves representing the soundfield using coefficients of spherical harmonic basis functions (also called "spherical harmonic coefficients" or SHC, "Higher-order Ambisonics" or HOA, and "HOA coefficients"). The future MPEG encoder may be described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats currently available. The formats range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce a soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \varphi_r\}$ is a point of reference (or observation point), $j_n(\bullet)$ is the spherical Bessel function of order n, and $Y_n^m$ $(\theta_n,\varphi_r)$ are the spherical harmonic basis functions of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1A is a diagram illustrating spherical harmonic basis functions from the zero order (n=0) to the fourth order (n=4). As can be seen, for each order, there is an expansion of suborders m which are shown but not explicitly noted in the example of FIG. 1A for ease of illustration purposes. A number of spherical harmonic basis functions for a particular order may be determined as: # basis functions=(n+1)^2. For example, a tenth order (n=10) would correspond to 122 spherical harmonic basis functions (e.g., (10+1)^2).

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is $\sqrt{-1}$, $h_n^{(2)}(\bullet)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the PCM stream) enables conversion of each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \varphi_r\}$.

Figure 1B:
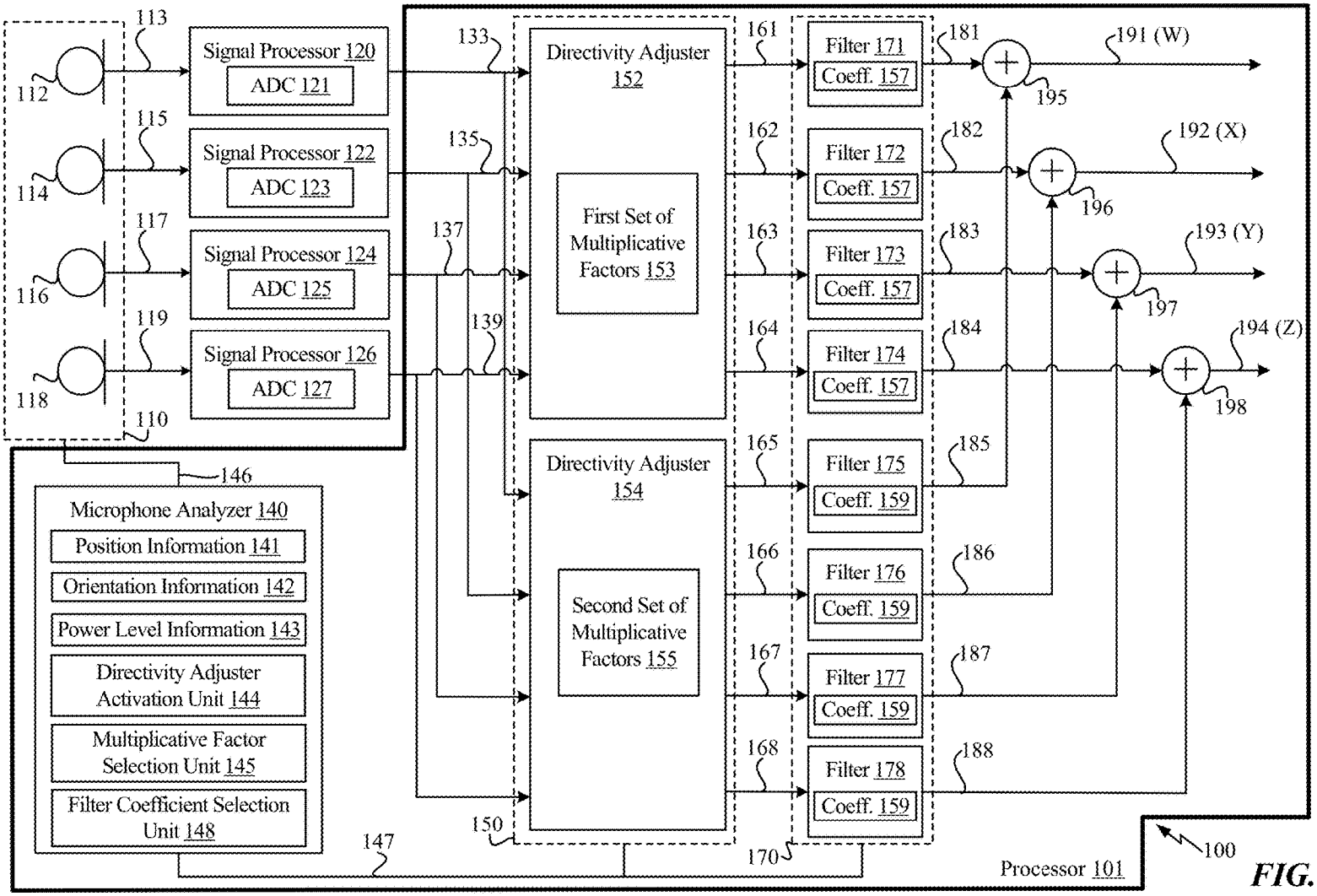
FIG. 1B is a block diagram illustrating an illustrative implementation of a system for generating first-order ambisonic signals using a microphone array.

Referring to FIG. 1B, a system 100 for generating first-order ambisonic signals using a microphone array is shown. The system 100 may be integrated into multiple devices. As non-limiting examples, the system 100 may be integrated into a robot, a mobile phone, a head-mounted display, a virtual reality headset, or an optical wearable (e.g., glasses).

The system 100 includes a processor 101 and a microphone array 110. The microphone array 110 includes a microphone 112, a microphone 114, a microphone 116, and a microphone 118. At least two microphones associated with the microphone array 110 are located on different two-dimensional planes. For example, the microphones 112, 114 may be located on a first two-dimensional plane, and the microphones 116, 118 may be located on a second two-dimensional plane. As another example, the microphone 112 may be located on the first two-dimensional plane, and the microphones 114, 116, 118 may be located on the second two-dimensional plane. According to one implementation, at least one microphone 112, 114, 116, 118 is an omnidirectional microphone. For example, at least one microphone 112, 114, 116, 118 is configured to capture sound with approximately equal gain for all sides and directions. According to one implementation, at least one of the microphones 112, 114, 116, 118 is a microelectromechanical system (MEMS) microphone.

In some implementations, each microphone 112, 114, 116, 118 is positioned within a cubic space having particular dimensions. For example, the particular dimensions may be defined by a two centimeter length, a two centimeter width, and a two centimeter height. As described herein, a number of active directivity adjusters 150 (e.g., adaptive directivity adjusters) in the system 100 and a number of active filters 170 (e.g., finite impulse response filters) in the system 100 may be based on whether each microphone 112, 114, 116, 118 is positioned within a cubic space having the particular dimensions. For example, the number of active directivity adjusters 150 and filters 170 is reduced if the microphones 112, 114, 116, 118 are located within a close proximity to each other (e.g., within the particular dimensions). However, it should be understood that the microphones 112, 114, 116, 118 may be arranged in different configurations (e.g., a spherical configuration, a triangular configuration, a random configuration, etc.) while positioned within the cubic space having the particular dimensions. Although the microphone array 110 is shown to include four microphones, in other implementations, the microphone array 110 may include fewer microphones. For example, the microphone array 110 may include three microphones.

The system 100 also includes signal processing circuitry that is coupled to the microphone array 110. The signal processing circuitry includes a signal processor 120, a signal processor 122, a signal processor 124, and a signal processor 126. The signal processing circuitry is configured to perform signal processing operations on analog signals captured by each microphone 112, 114, 116, 118 to generate digital signals.

To illustrate, the microphone 112 is configured to capture an analog signal 113, the microphone 114 is configured to capture an analog signal 115, the microphone 116 is configured to capture an analog signal 117, and the microphone 118 is configured to capture an analog signal 119. The signal processor 120 is configured to perform first signal processing operations (e.g., filtering operations, gain adjustment operations, analog-to-digital conversion operations) on the analog signal 113 to generate a digital signal 133. In a similar manner, the signal processor 122 is configured to perform second signal processing operations on the analog signal 115 to generate a digital signal 135, the signal processor 124 is configured to perform third signal processing operations on the analog signal 117 to generate a digital signal 137, and the signal processor 126 is configured to perform fourth signal processing operations on the analog signal 119 to generate a digital signal 139. Each signal processor 120, 122, 124, 126 includes an analog-to-digital converter (ADC) 121, 123, 125, 127, respectively, to perform the analog-to-digital conversion operations. According to one implementation, the ADCs 121, 123, 125, 127 are integrated into a coder/decoder (CODEC). According to another implementation, the ADCs 121, 123, 125, 127 are stand-alone ADCs. According to yet another implementation, the ADCs 121, 123, 125, 127 are included in the microphone array 110. Thus, in some scenarios, the microphone array 110 may generate the digital signals 133, 135, 137, 139.

Each digital signal 133, 135, 137, 139 is provided to the directivity adjusters 150 of the processor 101. In FIG. 1B, two directivity adjusters 152, 154 are shown. However, it should be understood that additional directivity adjusters may be included in the system 100. As a non-limiting example, the system 100 may include four directivity adjusters 150, eight directivity adjusters 150, etc. Although the number of directivity adjusters 150 included in the system 100 may vary, the number of active directivity adjusters 150 is based on information generated at a microphone analyzer 140 of the processor 101, as described below.

The microphone analyzer 140 is coupled to the microphone array 110 via a control bus 146, and the microphone analyzer 140 is coupled to the directivity adjusters 150 and the filters 170 via a control bus 147. The microphone analyzer 140 is configured to determine position information 141 for each microphone of the microphone array 110. The position information 141 may indicate the position of each microphone relative to other microphones in the microphone array 110. Additionally, the position information 141 may indicate whether each microphone 112, 114, 116, 118 is positioned within the cubic space having the particular dimensions (e.g., the two centimeter length, the two centimeter width, and the two centimeter height). The microphone analyzer 140 is further configured to determine orientation information 142 for each microphone of the microphone array 110. The orientation information 142 indicates a direction that each microphone 112, 114, 116, 118 is pointing. According to some implementations, the microphone analyzer 140 is configured to determine power level information 143 for each microphone of the microphone array 110. The power level information 143 indicates a power level for each microphone 112, 114, 116, 118.

The microphone analyzer 140 includes a directivity adjuster activation unit 144 that is configured to determine how many sets of multiplicative factors are to be applied to the digital signals 133, 135, 137, 139. For example, the directivity adjuster activation unit 144 may determine how many directivity adjusters 150 are activated. According to one implementation, there is a one-to-one relationship between the number of sets of multiplicative factors applied and the number of directivity adjusters 150 activated. The number of sets of multiplicative factors to be applied to the digital signals 133, 135, 137, 139 is based on whether each microphone 112, 114, 116, 118 is positioned within the cubic space having the particular dimensions. For example, the directivity adjuster activation unit 144 may determine to apply two sets of multiplicative factors (e.g., a first set of multiplicative factors 153 and a second set of multiplicative factors 155) to the digital signals 133, 135, 137, 139 if the position information 141 indicates that each microphone 112, 114, 116, 118 is positioned within the cubic space. Alternatively, the directivity adjuster activation unit 144 may determine to apply more than two sets of multiplicative factors (e.g., four sets, eights sets, etc.) to the digital signals 133, 135, 137, 139 if the position information 141 indicates that each microphone 112, 114, 116, 118 is not positioned within the particular dimensions. Although described above with respect to the position information, the directivity adjuster activation unit 144 may also determine how many sets of multiplicative factors are to be applied to the digital signals 133, 135, 137, 139 based on the orientation information, the power level information 143, other information associated with the microphones 112, 114, 116, 118, or a combination thereof.

The directivity adjuster activation unit 144 is configured to generate an activation signal (not shown) and send the activation signal to the directivity adjusters 150 and to the filters 170 via the control bus 147. The activation signal indicates how many directivity adjusters 150 and how many filters 170 are activated. According to one implementation, there is a direct relationship between the number of activated directivity adjusters 150 and the number of activated filters 170. To illustrate, there are four filters coupled to each directivity adjuster. For example, filters 171-174 are coupled to the directivity adjuster 152, and filters 175-178 are coupled to the directivity adjuster 154. Thus, if the directivity adjuster 152 is activated, the filters 171-174 are also activated. Similarly, if the directivity adjuster 154 is activated, the filters 175-178 are activated.

The microphone analyzer 140 also includes a multiplicative factor selection unit 145 configured to determine multiplicative factors used by each activated directivity adjuster 150. For example, the multiplicative factor selection unit 145 may select (or generate) the first set of multiplicative factors 153 to be used by the directivity adjuster 152 and may select (or generate) the second set of multiplicative factors 155 to be used by the directivity adjuster 154. Each set of multiplicative factors 153, 155 may be selected based on the position information 141, the orientation information 142, the power level information 143, other information associated with the microphones 112, 114, 116, 118, or a combination thereof. The multiplicative factor selection unit 145 sends each set of multiplicative factors 153, 155 to the respective directivity adjusters 152, 154 via the control bus 147.

The microphone analyzer 140 also includes a filter coefficient selection unit 148 configured to determine first filter coefficients 157 to be used by the filters 171-174 and second filter coefficients 159 to be used by the filter 175-178. The filter coefficients 157, 159 may be determined based on the position information 141, the orientation information 142, the power level information 143, other information associated with the microphones 112, 114, 116, 118, or a combination thereof. The filter coefficient selection unit 148 sends the filter coefficients to the respective filters 171-178 via the control bus 147.

It should be noted that operations of the microphone analyzer 140 may be performed after the microphones 112, 114, 116, 118 are positioned on a device (e.g., a robot, a mobile phone, a head-mounted display, a virtual reality headset, an optical wearable, etc.) and prior to introduction of the device in the market place. For example, the number of active directivity adjusters 150, the number of active filters 170, the multiplicative factors 153, 155, and the filter coefficients 157, 157 may be fixed based on the position, orientation, and power levels of the microphones 112, 114, 116, 118 during assembly. As a result, the multiplicative factors 153, 155 and the filter coefficients 157, 159 may be hardcoded into the system 100. According to other implementations, the number of active directivity adjusters 150, the number of active filters 170, the multiplicative factors 153, 155, and the filter coefficients 157, 157 may be determined "on the fly" by the microphone analyzer 140. For example, the microphone analyzer 140 may determine the position, orientation, and power levels of the microphones 112, 114, 116, 118 in "real-time" to adjust for changes in the microphone configuration. Based on the changes, the microphone analyzer 140 may determine the number of active directivity adjusters 150, the number of active filters 170, the multiplicative factors 153, 155, and the filter coefficients 157, 157, as described above.

The microphone analyzer 140 enables compensates for flexible microphone positions (e.g., a "non-ideal" tetrahedral microphone arrangement) by adjusting the number of active directivity adjusters 150, filters 170, multiplicative factors 153, 155, and filter coefficients 157, 159 based on the position of the microphones, the orientation of the microphones, etc. As described below, the directivity adjusters 150 and the filters 170 apply different transfer functions to the digital signals 133, 135, 137, 139 based on the placement and directivity of the microphones 112, 114, 116, 118.

The directivity adjuster 152 may be configured to apply the first set of multiplicative factors 153 to the digital signals 133, 135, 137, 139 to generate a first set of ambisonic signals 161-164. For example, the directivity adjuster 152 may apply the first set of multiplicative factors 153 to the digital signals 133, 135, 137, 139 using a first matrix multiplication. The first set of ambisonic signals includes a W signal 161, an X signal 162, a Y signal 163, and a Z signal 164.

The directivity adjuster 154 may be configured to apply the second set of multiplicative factors 155 to the digital signals 133, 135, 137, 139 to generate a second set of ambisonic signals 165-168. For example, the directivity adjuster 154 may apply the second set of multiplicative factors 155 to the digital signals 133, 135, 137, 139 using a second matrix multiplication. The second set of ambisonic signals includes a W signal 165, an X signal 166, a Y signal 167, and a Z signal 168.

The first set of filters 171-174 are configured to filter the first set of ambisonic signals 161-164 to generate a filtered first set of ambisonic signals 181-184. To illustrate, the filter 171 (having the first filter coefficients 157) may filter the W signal 161 to generate a filtered W signal 181, the filter 172 (having the first filter coefficients 157) may filter the X signal 162 to generate a filtered X signal 182, the filter 173 (having the first filter coefficients 157) may filter the Y signal 163 to generate a filtered Y signal 183, and the filter 174 (having the first filter coefficients 157) may filter the Z signal 164 to generate a filtered Z signal 184.

In a similar manner, the second set of filters 175-178 are configured to filter the second set of ambisonic signals 165-168 to generate a filtered second set of ambisonic signals 185-188. To illustrate, the filter 175 (having the second filter coefficients 159) may filter the W signal 165 to generate a filtered W signal 185, the filter 176 (having the second filter coefficients 159) may filter the X signal 166 to generate a filtered X signal 186, the filter 177 (having the second filter coefficients 159) may filter the Y signal 167 to generate a filtered Y signal 187, and the filter 178 (having the second filter coefficients 159) may filter the Z signal 168 to generate a filtered Z signal 188.

The system 100 also includes combination circuitry 195-198 coupled to the first set of filters 171-174 and to the second set of filters 175-178. The combination circuitry 195-198 is configured to combine the filtered first set of ambisonic signals 181-184 and the filtered second set of ambisonic signals 185-188 to generate a processed set of ambisonic signals 191-194. For example, a combination circuit 195 combines the filtered W signal 181 and the filtered W signal 185 to generate a W signal 191, a combination circuit 196 combines the filtered X signal 182 and the filtered X signal 186 to generate an X signal 192, a combination circuit 197 combines the filtered Y signal 183 and the filtered Y signal 187 to generate a Y signal 193, and a combination circuit 198 combines the filtered Z signal 184 and the filtered Z signal 188 to generate a Z signal 194. Thus, the processed set of ambisonic signals 191-194 may corresponds to a set of first order ambisonic signals that includes the W signal 191, the X signal 192, the Y signal 193, and the Z signal 194.

Thus, the system 100 of FIG. 1B converts recordings from the microphones 112, 114, 116, 118 to first order ambisonics. Additionally, the system 100 enables compensates for flexible microphone positions (e.g., a "non-ideal" tetrahedral microphone arrangement) by adjusting the number of active directivity adjusters 150, filters 170, sets of multiplicative factors 153, 155, and filter coefficients 157, 159 based on the position of the microphones, the orientation of the microphones, etc. For example, the system 100 applies different transfer functions to the digital signals 133, 135, 137, 139 based on the placement and directivity of the microphones 112, 114, 116, 118. Thus, the system 100 determines the four-by-four matrices (e.g., the directivity adjusters 150) and filters 170 that substantially preserve directions of audio sources when rendered onto loudspeakers. The four-by-four matrices and the filters may be determined using a model.

Because the system 100 converts the captured sounds to first order ambisonics, the captured sounds may be played back over a plurality of loudspeaker configurations and may the captured sounds may be rotated to adapt to a consumer head position. Although the techniques of FIG. 1 are described with respect to first order ambisonics, it should be appreciated that the techniques may also be performed using higher order ambisonics.

Figure 2:
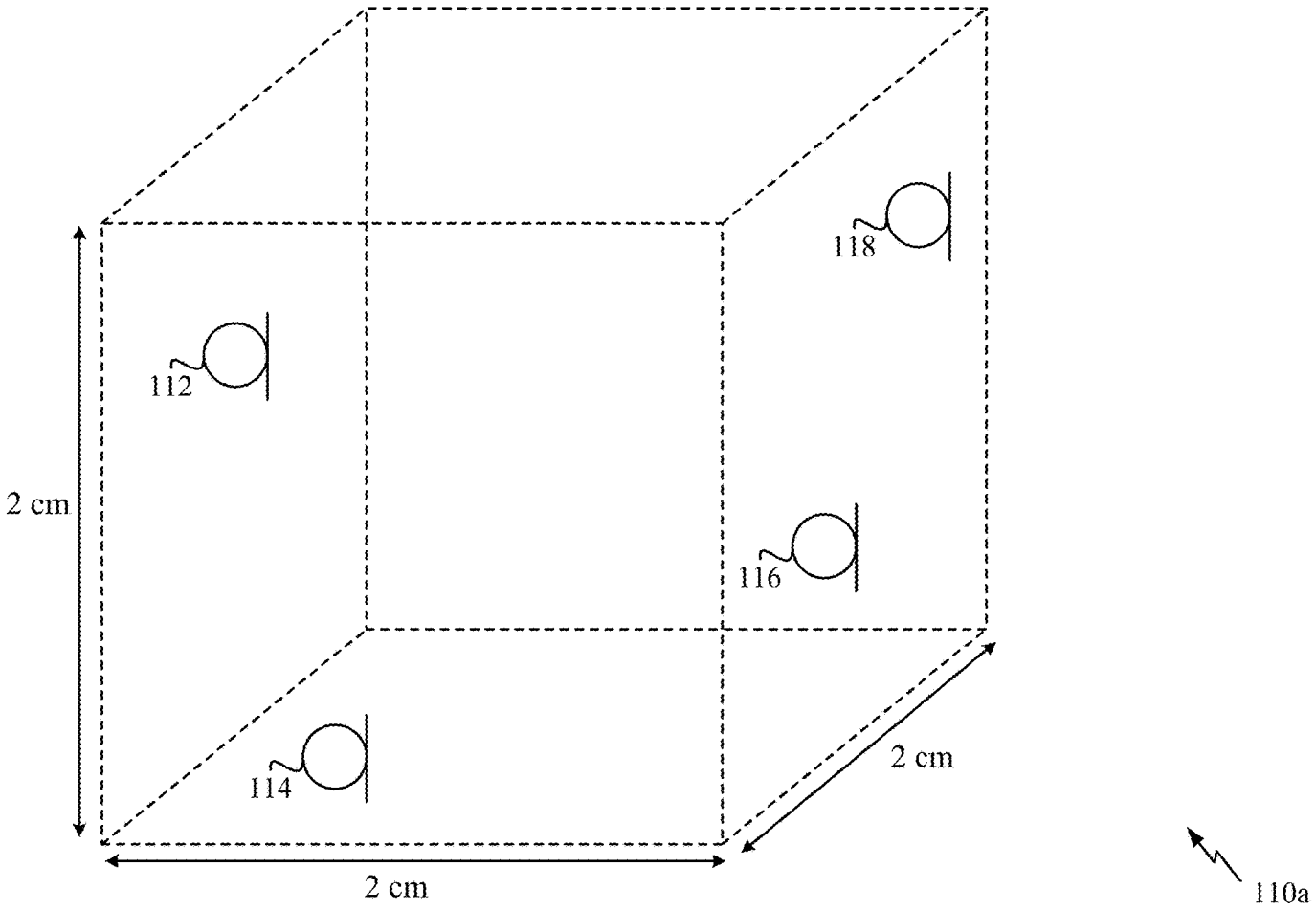
FIG. 2 illustrates a first implementation of the microphone array in FIG. 1B.

Referring to FIG. 2, a first implementation 110*a* of the microphone array 110 is shown. According to the first implementation 110*a*, each microphone 112, 114, 116, 118 is located within a cubic space having dimensions that are defined by a two centimeter length, a two centimeter width, and a two centimeter height. Thus, the directivity adjuster activation unit 144 may determine to use two directivity adjusters (e.g., the directivity adjusters 152, 154) to process the digital signals 133, 135, 137, 139 associated with the microphones 112, 114, 116, 118. Additionally, it should be noted that at least two microphones are located on different two-dimensional planes. For example, the microphones 116, 118 are located on one two-dimensional plane, the microphone 112 is located on a different two-dimensional plane, and the microphone 114 is located on another two-dimensional plane.

Figure 3:
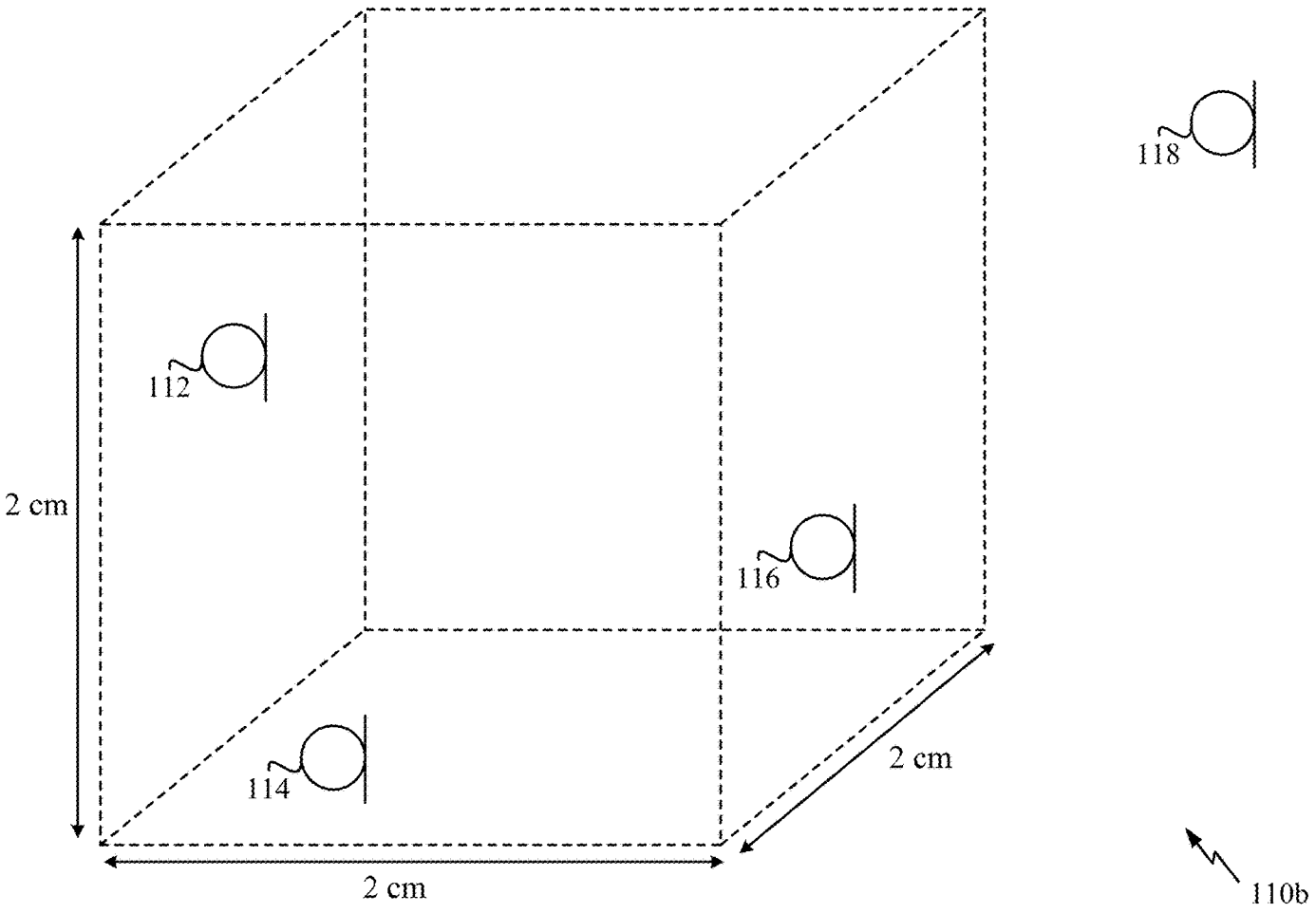
FIG. 3 illustrates a second implementation of the microphone array in FIG. 1B.

Referring to FIG. 3, a second implementation 110*b* of the microphone array 110 is shown. According to the second implementation 110*b*, each microphone 112, 114, 116 is located within a cubic space having dimensions that are defined by a two centimeter length, a two centimeter width, and a two centimeter height. However, the microphone 118 is not positioned within the particular dimensions of the cubic space. Thus, the directivity adjuster activation unit 144 may determine to use more than two directivity adjusters (e.g., four directivity adjusters, eight directivity adjusters, etc.) to process the digital signals 133, 135, 137, 139 associated with the microphones 112, 114, 116, 118.

Figure 4:
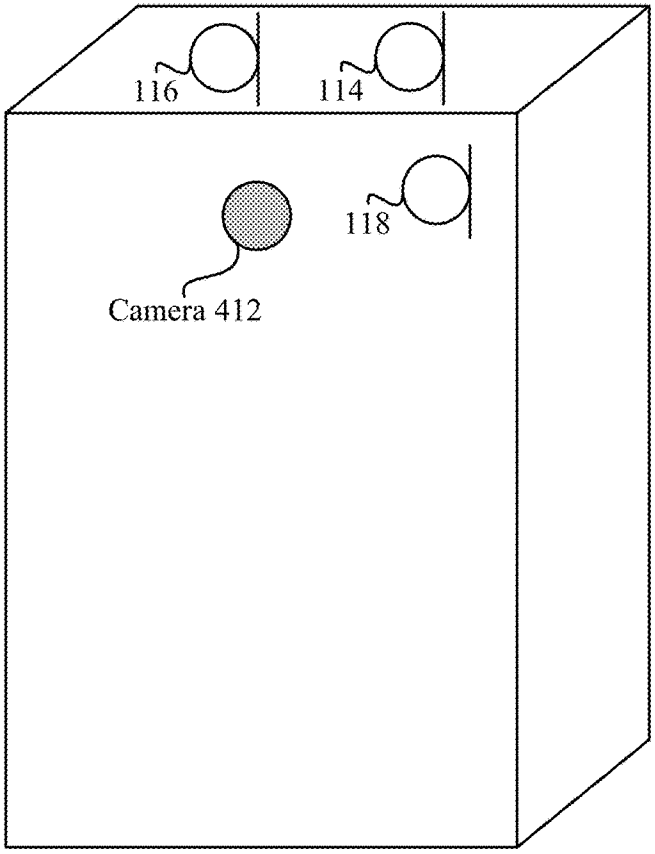
FIG. 4 illustrates an illustrative implementation of a mobile device that includes components of the microphone array in FIG. 1B.
Figure 4:
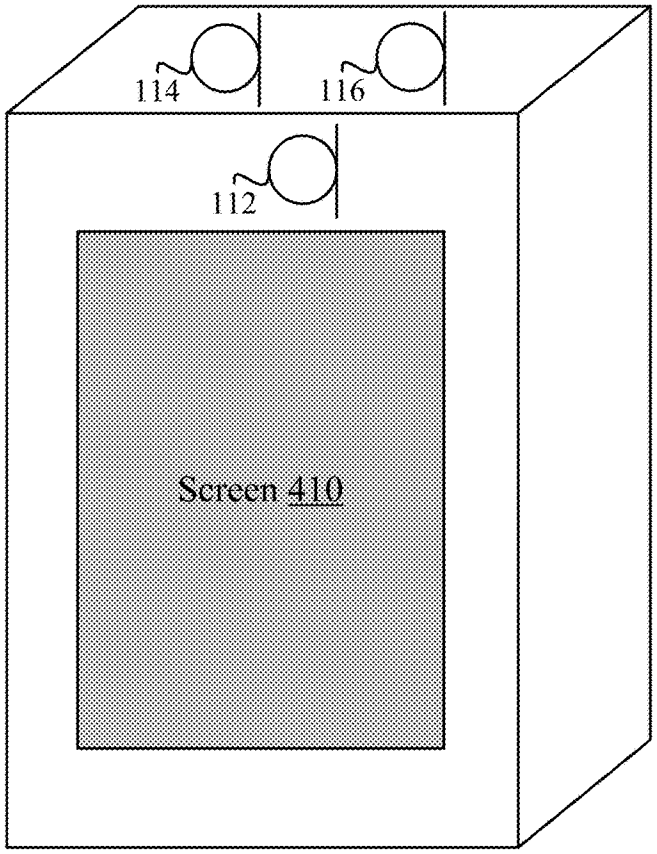

Referring to FIG. 4, a mobile device (e.g. a mobile phone) that includes the components of the microphone array 110 of FIG. 1B is shown. According to FIG. 4, the microphone 112 is located on a front side of the mobile device. For example, the microphone 112 is located near a screen 410 of the mobile device. The microphone 118 is located on a back side of the mobile device. For example, the microphone 118 is located near a camera 412 of the mobile device. The microphones 114, 116 are located on top of the mobile device.

If the microphones are located within a cubic space of the mobile device having dimensions (e.g., two centimeters x two centimeters x two centimeters) as shown in FIG. 2, the directivity adjuster activation unit 144 may determine to use two directivity adjusters (e.g., the directivity adjusters 152, 154) to process the digital signals 133, 135, 137, 139 associated with the microphones 112, 114, 116, 118. However, if at least one microphone is not located within the cubic space (as shown in FIG. 3), the directivity adjuster activation unit 144 may determine to use more than two directivity adjusters (e.g., four directivity adjusters, eight directivity adjusters, etc.) to process the digital signals 133, 135, 137, 139 associated with the microphones 112, 114, 116, 118.

Thus, the microphones 112, 114, 116, 118 may be located at flexible positions (e.g., a "non-ideal" tetrahedral microphone arrangement) on the mobile device of FIG. 4 and ambisonic signals may be generated using the techniques described above.

Figure 5A:
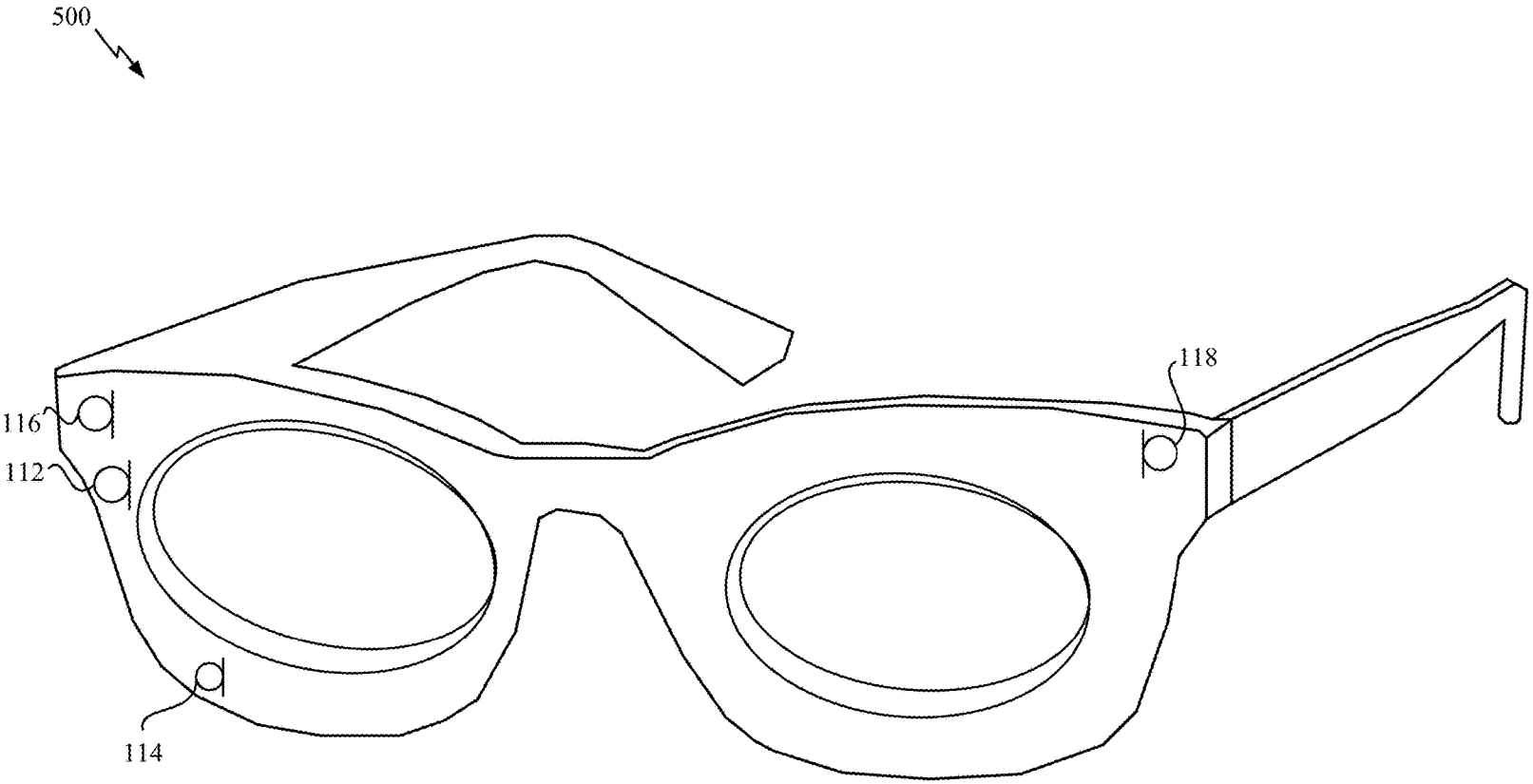
FIG. 5A illustrates an illustrative implementation of an optical wearable that includes components of the microphone array in FIG. 1B.

Referring to FIG. 5A, an optical wearable 500 that includes the components of the microphone array 110 of FIG. 1B is shown. According to FIG. 5A, the microphones 112, 114, 116 are located on a right side of the optical wearable 500, and the microphone 118 is located on a top-left corner of the optical wearable 500. Because the microphone 118 is not located within the cubic space (as shown in FIG. 3) of the other microphones 112, 114, 116, the directivity adjuster activation unit 144 determines to use more than two directivity adjusters (e.g., four directivity adjusters, eight directivity adjusters, etc.) to process the digital signals 133, 135, 137, 139 associated with the microphones 112, 114, 116, 118. Thus, the microphones 112, 114, 116, 118 may be located at flexible positions (e.g., a "non-ideal" tetrahedral microphone arrangement) on the optical wearable 500 of FIG. 5A and ambisonic signals may be generated using the techniques described above.

Figure 5B:
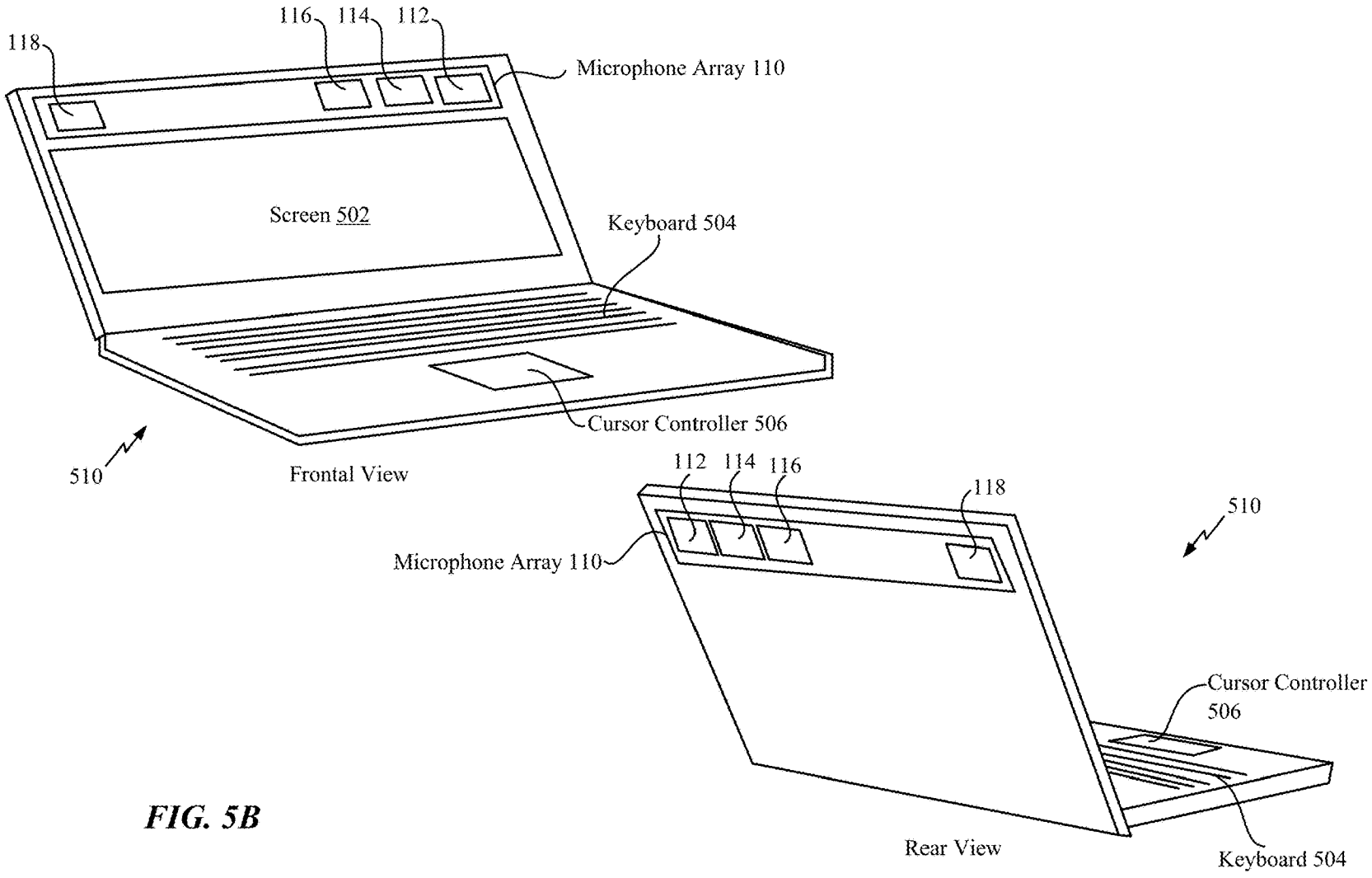
FIG. 5B illustrates an illustrative implementation of a computer that includes components of the microphone array in FIG. 1B.

Referring to FIG. 5B, a computer 510 (e.g., a laptop) that includes the components of the microphone array 110 of FIG. 1B is shown. The computer 510 includes a screen 502, a keyboard 504, and a cursor controller 506. In FIG. 5B, a frontal view of the computer 510 is shown and a rear view of the computer 510 is shown.

The microphone array 110 is located along an upper portion of the computer 510. The microphone 118 is located at the upper-left portion of the computer 510, and the microphones 112, 114, 116 are located at the upper-right portion of the computer 510. Thus, the microphones 112, 114, 116, 118 may be located at flexible positions (e.g., a "non-ideal" tetrahedral microphone arrangement) on the computer 510 and ambisonic signals may be generated using the techniques described above.

As illustrated in FIG. 5B, the microphone array 110 is located above the screen 502. However, in other implementations, the microphone array 110 may be positioned at other locations of the computer 510. As non-limiting examples, the microphone array 110 may be positioned along a bottom portion (e.g., by the cursor controller 506) of the computer 510 or may be positioned along a side portion of the computer 510.

Figure 5D:
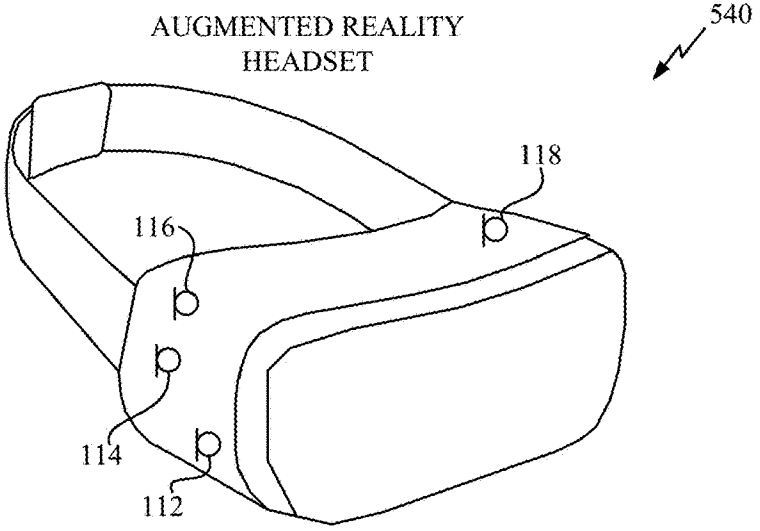
FIG. 5D illustrates an illustrative implementation of an augmented reality headset that includes components of the microphone array in FIG. 1B.
Figure 5C:
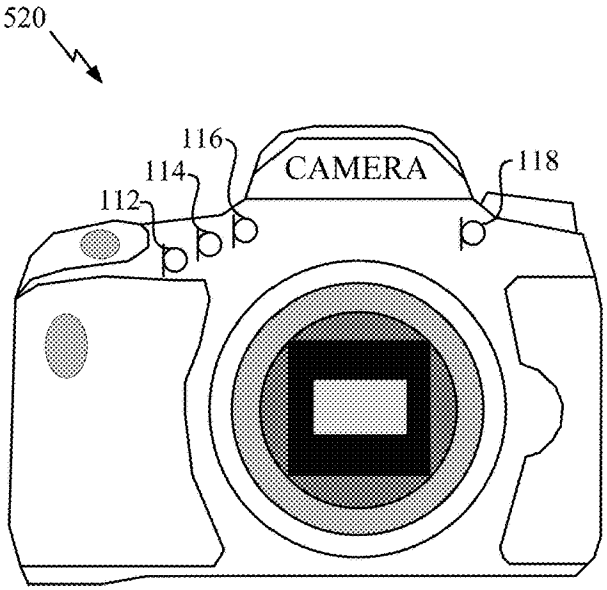
FIG. 5C illustrates an illustrative implementation of a camera that includes components of the microphone array in FIG. 1B.

Referring to FIG. 5C, a camera 520 that includes the components of the microphone array 110 of FIG. 1B is shown. For example, the camera 520 includes the microphone 112, the microphone 114, the microphone 116, and the microphone 118. The microphones 112, 114, 116 are located at the upper-left portion of the camera 520, and the microphone 118 is located at the upper-right portion of the camera 520. Thus, the microphones 112, 114, 116, 118 may be located at flexible positions (e.g., a "non-ideal" tetrahedral microphone arrangement) on the camera 520 and ambisonic signals may be generated using the techniques described above.

Referring to FIG. 5D, an augmented reality headset 540 that includes the components of the microphone array 110 of FIG. 1B is shown. According to FIG. 5D, the microphones 112, 114, 116 are located on a right side of the augmented reality headset 540, and the microphone 118 is located on a top-left corner of the augmented reality headset 540. Because the microphone 118 is not located within the cubic space (as shown in FIG. 3) of the other microphones 112, 114, 116, the directivity adjuster activation unit 144 determines to use more than two directivity adjusters (e.g., four directivity adjusters, eight directivity adjusters, etc.) to process the digital signals 133, 135, 137, 139 associated with the microphones 112, 114, 116, 118. Thus, the microphones 112, 114, 116, 118 may be located at flexible positions (e.g., a "non-ideal" tetrahedral microphone arrangement) on the augmented reality headset 540 and ambisonic signals may be generated using the techniques described above.

Figure 6A:
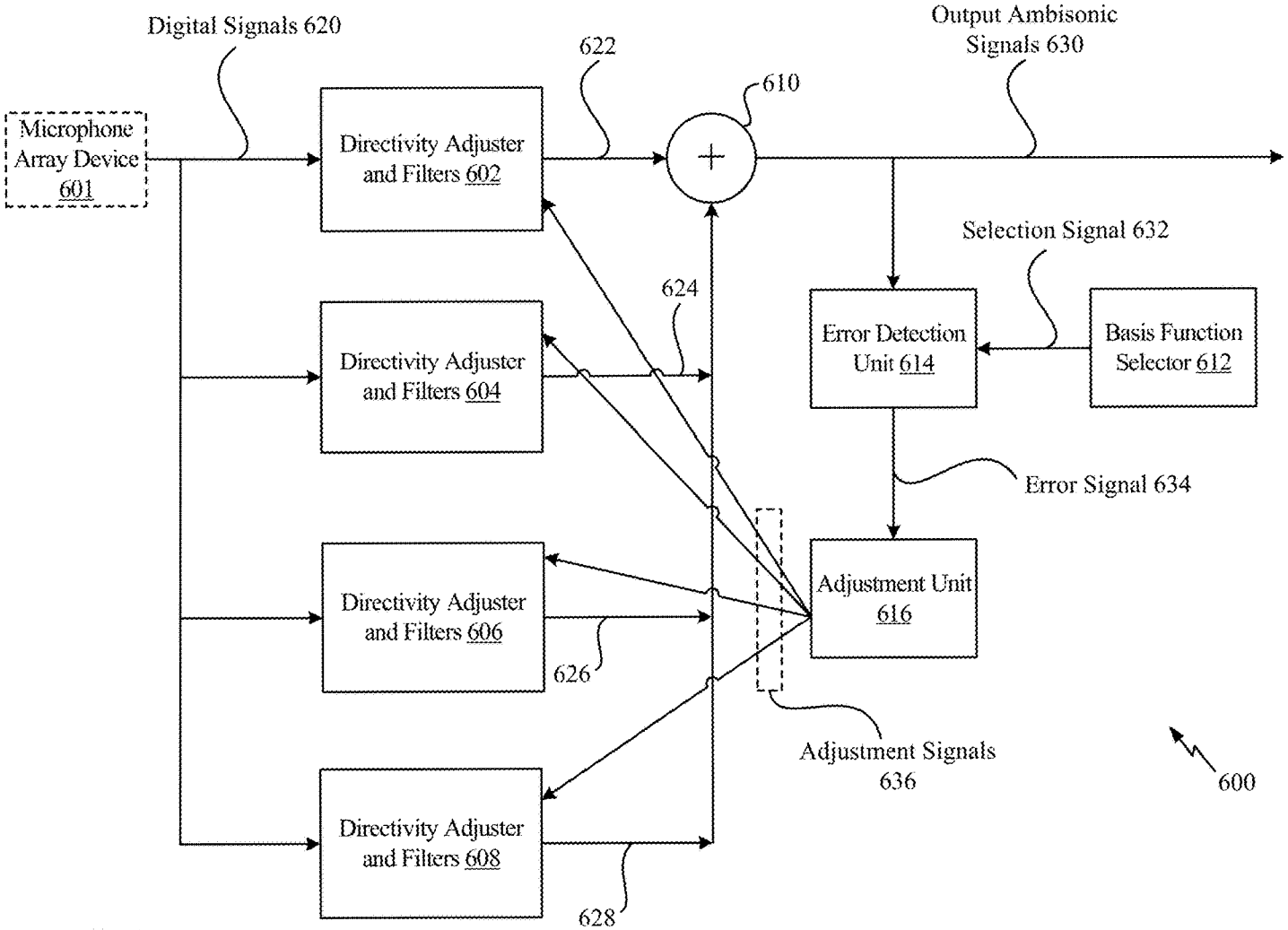
FIG. 6A illustrates a second illustrative implementation of a system for generating first-order ambisonic signals using a microphone array.

Referring to FIG. 6A, a system 600 for generating first-order ambisonic signals using a microphone array is shown. The system 600 may be integrated into multiple devices. As non-limiting examples, the system 600 may be integrated into a robot, a mobile phone, a head-mounted display, a computer, a virtual reality headset, or an optical wearable (e.g., glasses). According to some implementations, the system 600 may be integrated into the optical wearable 500 of FIG. 5A, the computer 510 of FIG. 5B, the camera 520 of FIG. 5C, or the augmented reality headset 540 of FIG. 5D.

The system 600 includes a microphone array device 601, a directivity adjuster and corresponding filters 602, a directivity adjuster and corresponding filters 604, a directivity adjuster and corresponding filters 606, a directivity adjuster and corresponding filters 608, a basis function selector 612, an error detection unit 614, and an adjustment unit 616. The microphone array 601 is configured to capture audio and convert the captured audio into digital signals 620. To illustrate, the microphone array device 601 may include the microphones 112, 114, 116, 118 of FIG. 1 and the signal processors 120, 122, 124, 126 of FIG. 1. For example, the microphone array device 601 may capture audio (e.g., analog signals 113, 115, 117, 119) from the four different microphones 112, 114, 116, 116 and may convert the captured audio into the digital signals 133, 135, 137, 139. Thus, in FIG. 6A, the digital signals 620 may correspond to a combined version of the digital signals 133, 135, 137, 139 of FIG. 1.

The digital signals 620 are provided to each directivity adjuster and the corresponding filters 602-608. The directivity adjuster and corresponding filters 602 may correspond to the directivity adjuster 152 and the filters 171-174 of FIG. 1 and may operate in a substantially similar manner. For example, the directivity adjuster and corresponding filters 602 may generate a filtered first set of ambisonic signals 622 that correspond to the filtered first set of ambisonic signals 181-184 of FIG. 1. The directivity adjuster and corresponding filters 604 may correspond to the directivity adjuster 154 and the filters 175-178 of FIG. 1 and may operate in a substantially similar manner. For example, the directivity adjuster and corresponding filters 604 may generate a filtered second set of ambisonic signals 624 that correspond to the filtered second set of ambisonic signals 185-188 of FIG. 1. The other directivity adjusters and corresponding filters 606, 608 may have similar configurations as the directivity adjusters and corresponding filters 602, 604 and may operate in substantially similar manners. For example, the directivity adjuster and corresponding filters 606 may generate a filtered third set of ambisonic signals 626. Additionally, the directivity adjuster and corresponding filters 608 may generate a filtered fourth set of ambisonic signals 628.

According to some implementations, each of the directivity adjusters and the corresponding filters 602-608 have a different basis function. According to one implementation, each of the directivity adjusters and the corresponding filters 602-608 generate signals specific to a particular quadrant of a sphere. For example, each of the directivity adjusters and the corresponding filters 602-608 may generate signals having X-axis components, Y-axis components, and Z-axis components associated with a spherical quadrant.

According to some implementations, transfer functions for sources are determined at several directions G(theta, phi, f), where f is frequency, theta is azimuth, and phi is elevation. The transfer functions are converted to a spherical harmonics basis function of order N. For each basis function, the matrix of frequency dependent weights (e.g., the weights (or multiplicative factors) applied to the directivity adjusters and the corresponding filters 602-608) applied to the microphone array 110 is derived. An aliasing cancellation beamformer (not shown) takes into account relative directive gains and phases between the microphones 112, 114, 116, 118.

A combination circuit 610 is configured to combine each filtered set of ambisonic signals 622-628 to generate output ambisonic signals 630. For example, the combination circuit 610 may combine the filtered first set of ambisonic signals 622, the filtered second set of ambisonic signals 624, the filtered third set of ambisonic signals 626, and the filtered fourth set of ambisonic signals 628 to generate the output ambisonic signals 630. According to one implementation, the output ambisonic signals 630 may correspond to the processed set of ambisonic signals 191-194 of FIG. 1. For example, the output ambisonic signals 630 may include the W signal 191, the X signal 192, the Y signal 193, and the Z signal 194.

The basis function selector 612 is configured to select a basis function (e.g., a desired basis function or desired beam-pattern) for the output ambisonic signals 630. According to one implementation, the basis function selector 612 selects a first-order ambisonic beam-pattern as the basis function such that the W signal, the X signal, the Y signal, and the Z signal of the output ambisonic signals 630 are equally (or substantially equally) amplified. The basis function selector 612 may generate a selection signal 632 indicating the selection of the first-order ambisonic beam-pattern and may provide the selection signal 632 to the error detection unit 614. In other implementations, other basis functions are selected.

Figure 7:
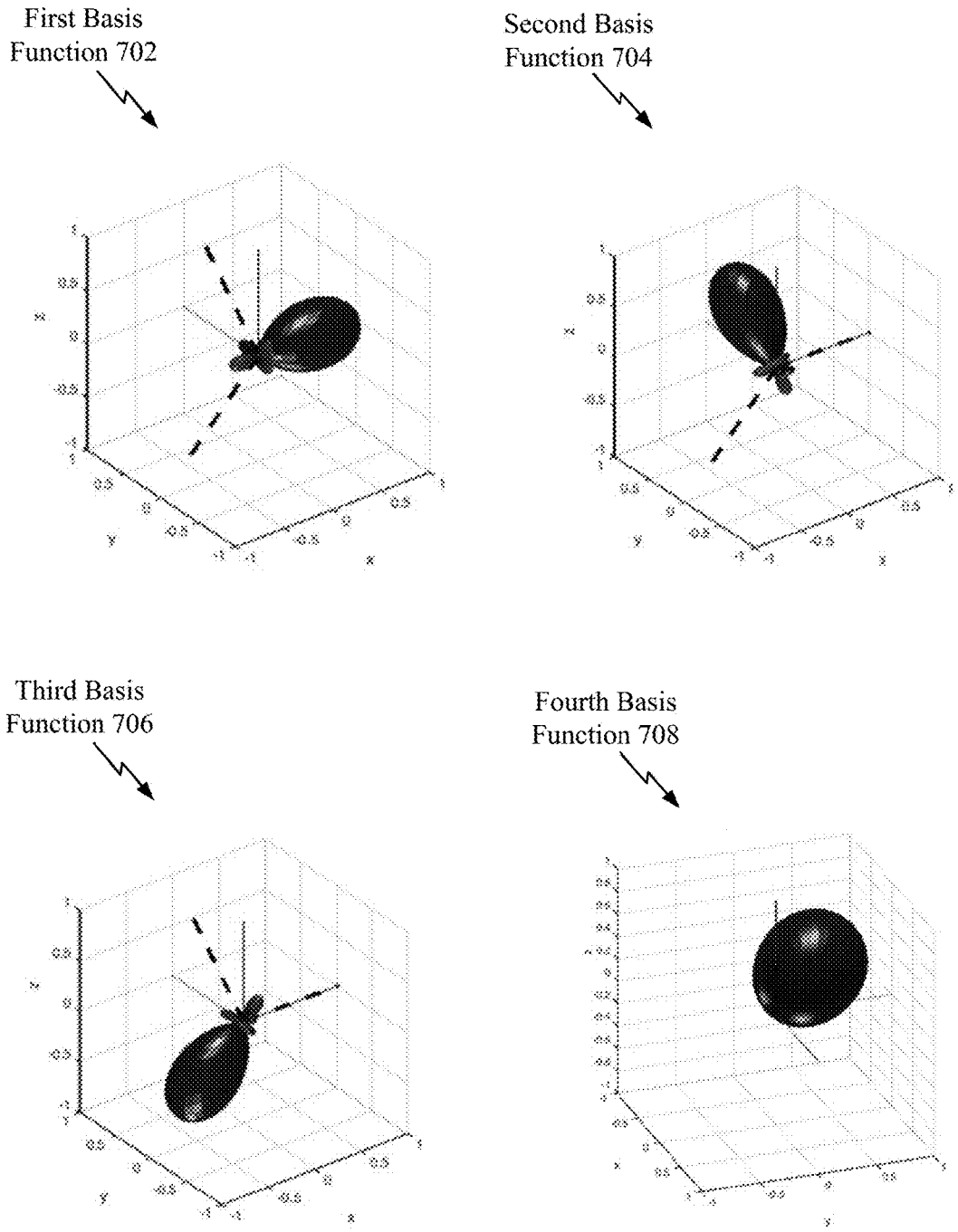
FIG. 7 depicts illustrative examples of different basis functions.

Non-limiting examples of different basis functions are illustrated in FIG. 7. For example, a first basis function 702 may amplify audio output in the X-direction and may reduce audio output in the Y-direction and the Z-direction. A second basis function 704 may amplify audio output in the Z-direction and may reduce audio output in the X-direction and the Y-direction. A third basis function 706 may amplify audio output in the Y-direction and may reduce audio output in the X-direction and the Z-direction. A fourth basis function 708 may amplify audio output in each direction (e.g., the X-direction, the Y-direction, and the Z-direction). The selection signal 632 may indicate which of the particular basis functions 702-708 (or another basis function) is selected by the basis function selector 612.

According to another implementation, the basis function selector 612 is responsive to a user selection. To illustrate, a user can select four different directions on a sphere with associated gains and widths. The basis function selector 612 may automatically generate a set of beam-patterns (e.g., basis functions) based on the selection. According to another implementation, the basis functions 702-708 may be displayed on a graphical user interface. If the user selects the first basis function 702, a higher gain may be selected for the first basis function 702 than the remaining basis functions 704-708. The user may select a desired basis function and the basis function selector 612 may generate the selection signal 632 based on the user's selection.

In other implementations, the user selects a particular mode (or use case), and the basis function selector 612 selects a basis function based on the particular mode. A non-limiting example of a mode may include a "sound source isolation" mode. To illustrate, the user may determine that a sound source is located on a particular axis or in a particular direction. As a non-limiting example, the user may determine that the sound source is located in front of the user. The user may provide information associated with the location of the sound source to the basis function selector 612. Based on the information, the basis function selector 612 may determine that the Y-axis (e.g., the Y-direction) is directly in front of the user. As a result, the basis function selector 612 may select the third basis function 706 and provide an indication of the third basis function as the selection signal 632. Another non-limiting example of a mode may include a "crisp sound" mode. To illustrate, the user may select to receive a clearer (e.g., "crisp") sound. The user may provide an indication to the basis function selector 612, and the basis function selector 612 may select a basis function that will produce a clearer sound.

According to other implementations, the basis function selector 612 selects a basis function based on the position information 141, the orientation information 142, or both. For example, the selected basis function may be adjusted if positions of the microphones 112, 114, 116, 118 are adjusted, if orientations of the microphones 112, 114, 116, 118 are adjusted, or both. To illustrate, if the microphone 116 depicted in FIG. 5D is repositioned to be located on the head-strap of the augmented reality headset 540, the basis function selector 612 may select a different basis function. According to other implementations, the basis function selector 612 selects a basis function that amplifies the sound of a moving object that is tracked by the augmented reality headset 540 or the camera 520. As a non-limiting example, the selected basis function may be based on data received from the augmented reality headset 540, such as position data associated with the moving object, speed data associated with the moving object, acceleration data associated with the moving object, etc.

According to one implementation, one or more cameras (e.g., the camera 520, cameras on the computer 510, cameras on the augmented reality headset 540, etc.) are configured to capture one or more areas of interest surrounding the microphone array 110. According to one implementation, the one or more cameras may be located on augmented glasses pointing to the areas of interest. The basis function may be selected based on corresponding probabilities of audio activity in the one or more areas of interest. To illustrate, basis functions may be removed from consideration if the basis functions are associated with capturing audio activity in areas where there is a low probability of audio activity. Additionally, basis functions may be selected if the basis functions are associated with capturing audio activity in areas where there is a high probability of audio activity. As another example, video data from the one or more cameras may indicate that speakers (or other audio sources) are clustered within a particular quadrant. Based on the video data, basis functions (e.g., three basis functions) may be selected to increase audio resolution in the particular quadrant, and a single basis function may be selected to capture audio in the other quadrants.

The error detection unit 614 is configured to compare the selected beam-pattern (e.g., the beam-pattern associated with the selected basis function indicated by the selection signal 612) and the actual beam-pattern (e.g., the beam-pattern associated with the output ambisonic signals 630). For example, the error detection unit 614 may perform a least squares comparison based on the selected beam-pattern and the actual beam-pattern. According to some implementations, the error detection unit 614 performs comparisons based on magnitude components for high-frequency signals and bypasses use of phase components because magnitude components are the dominant components. The error detection unit 614 generates an error signal 634 that indicates the difference between the selected beam-pattern and the actual beam-pattern.

The error signal 634 is provided to the adjustment unit 616. The adjustment unit 616 is configured to adjust the directivity adjusters and corresponding filters 602-608 to reduce the error associated with the error signal 634. For example, the adjustment unit 616 may generate adjustment signals 636 that cause the directivity adjusters and filters 602-608 to be adjusted. The adjustment unit 616 adjusts the directivity adjuster and corresponding filters 602 until the error cannot be further reduced. After adjusting the directivity adjuster and corresponding filters 602, the adjustment unit 616 adjusts the directivity adjuster and filters 604 until the error cannot be further reduced. The other directivity adjusters and corresponding filters 606, 608 are adjusted according to a similar pattern until the error is below a particular threshold. As a non-limiting example, the directivity adjusters and corresponding filters 602-608 may be adjusted until the error is less than ten percent.

Figure 6B:
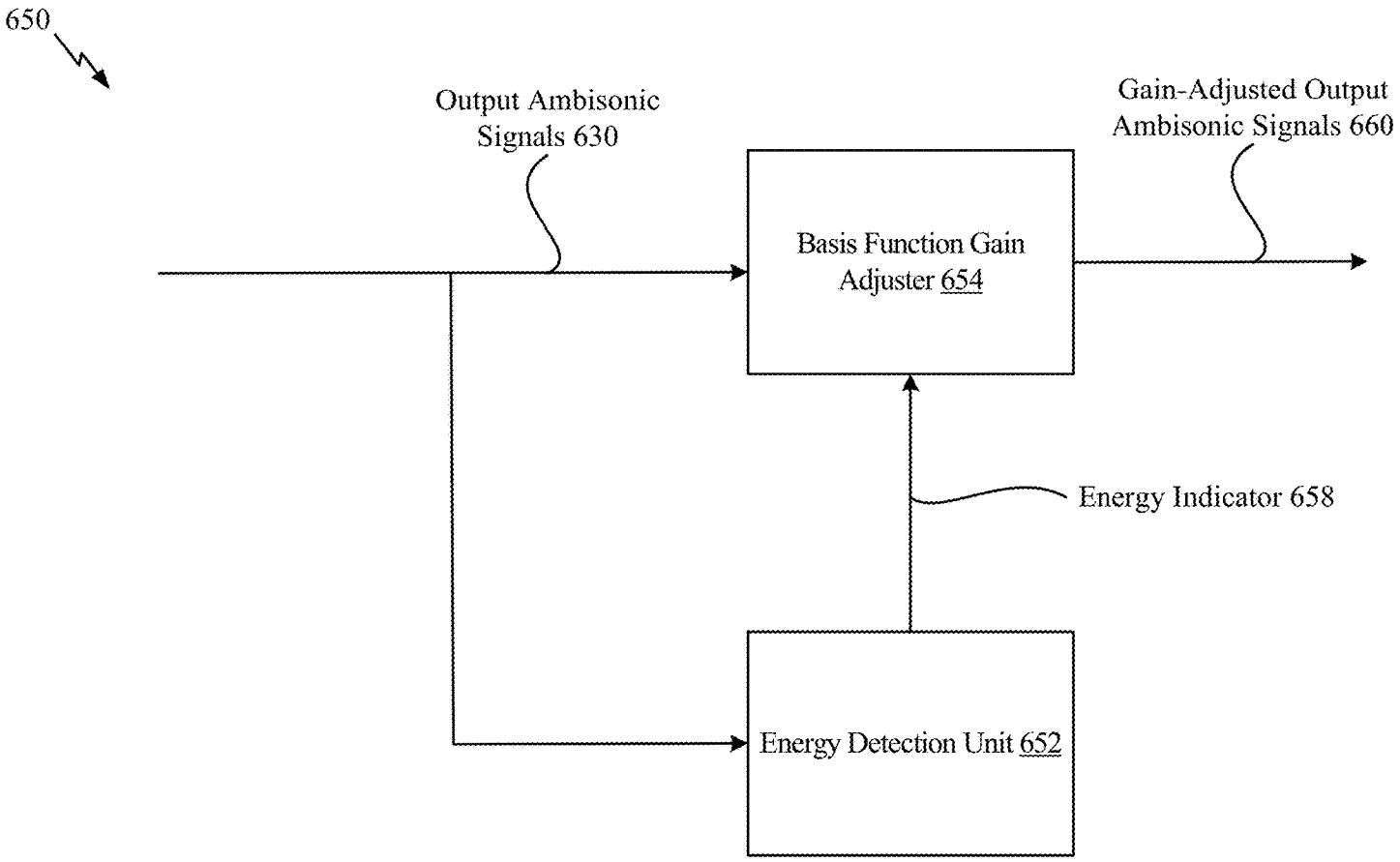
FIG. 6B illustrates an illustrative implementation of a system for adjusting a gain for different basis functions.

Referring to FIG. 6B, a system 650 for adjusting a gain for different basis functions is shown. The system 650 includes an energy detection unit 652 and a basis function gain adjuster 654.

The energy detection unit 652 is configured to determine (e.g., calculate) the audio energy for the output ambisonic signals 630 associated with the directivity adjusters and the corresponding filters 602-608 of FIG. 6A. For example, the output ambisonic signals 630 are provided to the energy detection unit 652, and the energy detection unit 652 determines the energy for each signal of the output ambisonic signals 630. The audio energy may be based on a perceptual volume that is weighted in the perceptual frequency sub-bands. The audio energy is provided to the basis function gain adjuster 654 via an energy indicator 658.

The basis function gain adjuster 654 is configured to modify audio energy in different ambisonic outputs (e.g., different signals of the output ambisonic signals) to generate gain-adjusted output ambisonic signals 660. For example, the user may select an option where audio energy in certain directions is higher (e.g., louder) than audio energy in other directions. Thus, the basis function gain adjuster 654 may use a user preference to adjust audio energy in different signals of the output ambisonic signals 630. According to one implementation, audio energy gain (or reduction) may be applied to the output ambisonic signals 630 up to a particular threshold (e.g., a ten percent audio energy gain or a ten percent audio energy reduction).

The techniques described with respect to FIG. 6B may be used for augmented reality headsets where audio realized from the front has a higher energy than audio realized from other directions. For example, if audio is very loud in all directions, audio energy associated with audio from the front may be increased to improve user perception and user experience.

Figure 8A:
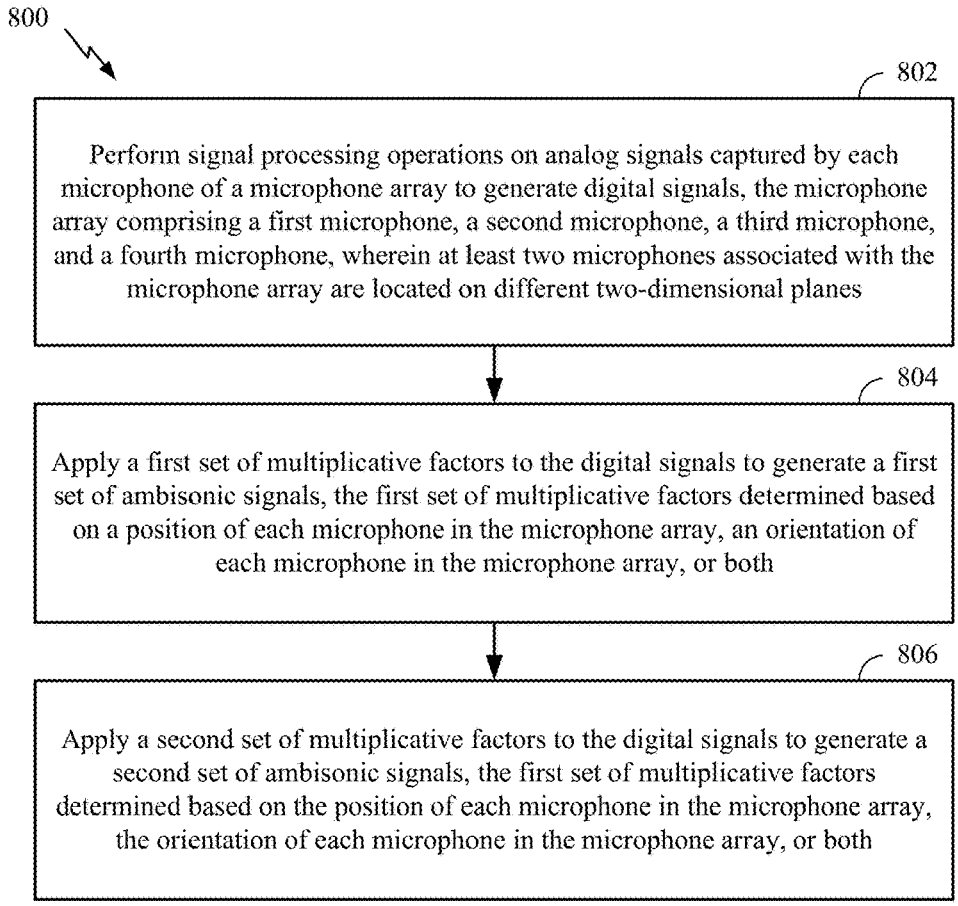
FIG. 8A illustrates an example of a method for generating first-order ambisonic signals using a microphone array.

Referring to FIG. 8A, a method 800 for generating first-order ambisonic signals using a microphone array is shown. The method 800 may be performed by the system 100 of FIG. 1B, the system 600 of FIG. 6A, or both.

The method 800 includes performing signal processing operations on analog signals captured by each microphone of a microphone array to generate digital signals, at 802. The microphone array includes a first microphone, a second microphone, a third microphone, and a fourth microphone, and at least two microphones associated with the microphone array are located on different two-dimensional planes. For example, referring to FIG. 1B, the microphone 112 captures the analog signal 113, the microphone 114 captures the analog signal 115, the microphone 116 captures the analog signal 117, and the microphone 118 captures the analog signal 119. The signal processor 120 performs first signal processing operations on the analog signal 113 to generate the digital signal 133, the signal processor 122 performs second signal processing operations on the analog signal 115 to generate the digital signal 135, the signal processor 124 performs third signal processing operations on the analog signal 117 to generate the digital signal 137, and the signal processor 126 performs fourth signal processing operations on the analog signal 119 to generate the digital signal 139. According to some implementations, the front of the mobile device in FIG. 4 represents a first two-dimensional plane, and the back of the mobile device represents a second two-dimensional plane.

The method 800 also includes applying a first set of multiplicative factors to the digital signals to generate a first set of ambisonic signals, at 804. The first set of multiplicative factors is determined based on a position of each microphone in the microphone array, an orientation of each microphone in the microphone array, or both. For example, referring to FIG. 1B, the directivity adjuster 152 applies the first set of multiplicative factors 153 to the digital signals 133, 135, 137, 139 to generate the first set of ambisonic signals 161-164. For example, the directivity adjuster 152 may apply the first set of multiplicative factors 153 to the digital signals 133, 135, 137, 139 using the first matrix multiplication. The first set of ambisonic signals includes the W signal 161, the X signal 162, the Y signal 163, and the Z signal 164. The set of multiplicative factors 153 is selected based on the position information 141, the orientation information 142, the power level information 143, other information associated with the microphones 112, 114, 116, 118, or a combination thereof.

The method 800 also includes applying a second set of multiplicative factors to the digital signals to generate a second set of ambisonic signals, at 806. The second set of multiplicative factors is determined based on the position of each microphone in the microphone array, the orientation of each microphone in the microphone array, or both. For example, referring to FIG. 1B, the directivity adjuster 154 applies the second set of multiplicative factors 155 to the digital signals 133, 135, 137, 139 to generate the second set of ambisonic signals 165-168. For example, the directivity adjuster 154 may apply the second set of multiplicative factors 155 to the digital signals 133, 135, 137, 139 using the second matrix multiplication. The second set of ambisonic signals includes the W signal 165, the X signal 166, the Y signal 167, and the Z signal 168. The set of multiplicative factors 155 is selected based on the position information 141, the orientation information 142, the power level information 143, other information associated with the microphones 112, 114, 116, 118, or a combination thereof.

Figure 8B:
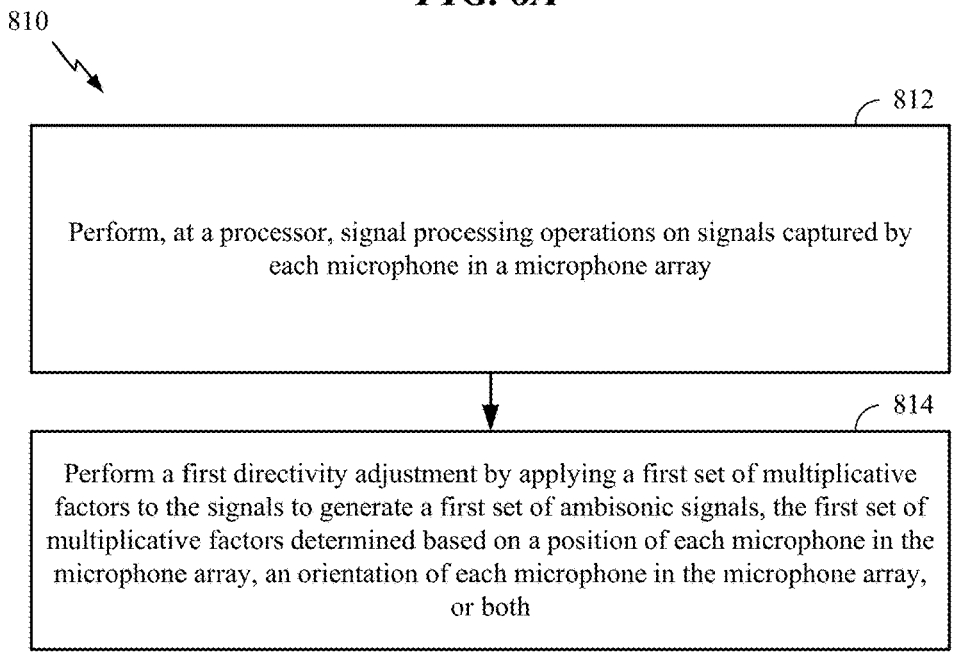
FIG. 8B illustrates a second example of a method for generating first-order ambisonic signals using a microphone array.

Referring to FIG. 8B, a method 810 for generating first-order ambisonic signals using a microphone array is shown. The method 810 may be performed by the system 100 of FIG. 1B, the system 600 of FIG. 6A, or both.

The method 810 includes performing, at a processor, signal processing operations on signals captured by each microphone in a microphone array, at 812. For example, referring to FIG. 1B, the microphone 112 captures the analog signal 113, the microphone 114 captures the analog signal 115, the microphone 116 captures the analog signal 117, and the microphone 118 captures the analog signal 119. The signal processor 120 performs first signal processing operations on the analog signal 113 to generate the digital signal 133, the signal processor 122 performs second signal processing operations on the analog signal 115 to generate the digital signal 135, the signal processor 124 performs third signal processing operations on the analog signal 117 to generate the digital signal 137, and the signal processor 126 performs fourth signal processing operations on the analog signal 119 to generate the digital signal 139.

The method 810 also includes performing a first directivity adjustment by applying a first set of multiplicative factors to the signals to generate a first set of ambisonic signals, at 814. The first set of multiplicative factors is determined based on a position of each microphone in the microphone array, an orientation of each microphone in the microphone array, or both. For example, referring to FIG. 1B, the directivity adjuster 152 applies the first set of multiplicative factors 153 to the digital signals 133, 135, 137, 139 to generate the first set of ambisonic signals 161-164. For example, the directivity adjuster 152 may apply the first set of multiplicative factors 153 to the digital signals 133, 135, 137, 139 using the first matrix multiplication. The first set of ambisonic signals includes the W signal 161, the X signal 162, the Y signal 163, and the Z signal 164. The set of multiplicative factors 153 is selected based on the position information 141, the orientation information 142, the power level information 143, other information associated with the microphones 112, 114, 116, 118, or a combination thereof.

According to some implementations, the method 810 includes selecting at least one basis function for the first directivity adjustment. For example, the basis function selector 612 of FIG. 6A may select the basis function. According to one implementation, one or more cameras (e.g., the camera 520, cameras on the computer 510, cameras on the augmented reality headset 540, etc.) are configured to capture one or more areas of interest surrounding the microphone array 110. The basis function may be selected based on corresponding probabilities of audio activity in the one or more areas of interest. For example, basis functions may be removed from consideration if the basis functions are associated with capturing audio activity in areas where there is a low probability of audio activity. As another example, video data from the one or more cameras may indicate that speakers are clustered within a particular quadrant. Based on the video data, basis functions (e.g., three basis functions) may be selected to increase audio resolution in the particular quadrant and another basis function may be selected to capture audio in the other quadrants.

Thus, the methods 800 of FIG. 8A-8B convert recordings from the microphones 112, 114, 116, 118 to first order ambisonics. Additionally, the method 800 compensates for flexible microphone positions (e.g., a "non-ideal" tetrahedral microphone arrangement) by adjusting the number of active directivity adjusters, filters, multiplicative factors, and filter coefficients based on the position of the microphones, the orientation of the microphones, etc. For example, the method 800 applies different transfer functions to the digital signals based on the placement and directivity of the microphones. Thus, the methods 800, 810 determine the four-by-four matrices (e.g., the directivity adjusters 150) and filters 170 that substantially preserve directions of audio sources when rendered onto loudspeakers. The four-by-four matrices and the filters may be determined using a model.

Figure 9:
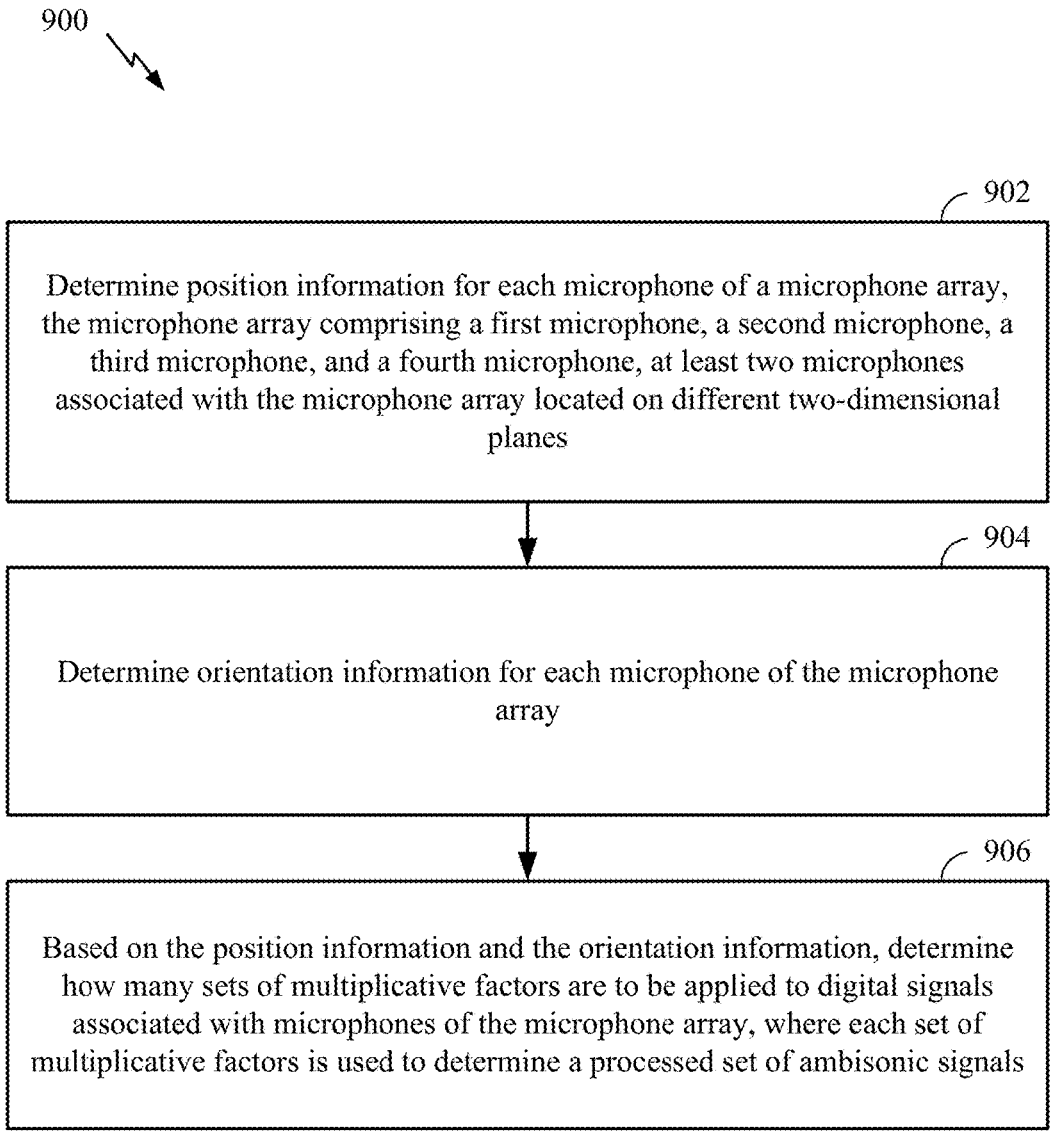
FIG. 9 illustrates a third example of a method for generating first-order ambisonic signals using a microphone array.

Referring to FIG. 9, a method 900 for generating first-order ambisonic signals using a microphone array is shown. The method 900 may be performed by the system 100 of FIG. 1B, the system 600 of FIG. 6A, or both.

The method 900 includes determining position information for each microphone of a microphone array, at 902. The microphone array includes a first microphone, a second microphone, a third microphone, and a fourth microphone, and at least two microphones associated with the microphone array are located on different two-dimensional planes. For example, referring to FIG. 1B, the microphone analyzer 140 determines the position information 141 for each microphone of the microphone array 110. The position information 141 indicates the position of each microphone relative to other microphones in the microphone array 110. Additionally, the position information 141 indicates whether each microphone 112, 114, 116, 118 is positioned within the cubic space having the particular dimensions (e.g., the two centimeter length, the two centimeter width, and the two centimeter height).

The method 900 also includes determining orientation information for each microphone of the microphone array, at 904. For example, referring to FIG. 1B, the microphone analyzer 140 determines the orientation information 142 for each microphone of the microphone array 110. The orientation information 142 indicates a direction that each microphone 112, 114, 116, 118 is pointing.

The method 900 also includes based on the position information and the orientation information, determining how many sets of multiplicative factors are to be applied to digital signals associated with microphones of the microphone array, at 906. For example, referring to FIG. 1B, the directivity adjuster activation unit 144 determines how many sets of multiplicative factors are to be applied to the digital signals 133, 135, 137, 139. For example, the directivity adjuster activation unit 144 determines how many directivity adjusters 150 are activated. According to one implementation, there is a one-to-one relationship between the number of sets of multiplicative factors applied and the number of directivity adjusters 150 activated. The number of sets of multiplicative factors to be applied to the digital signals 133, 135, 137, 139 is based on whether each microphone 112, 114, 116, 118 is positioned within the cubic space having the particular dimensions. For example, the directivity adjuster activation unit 144 may determine to apply two sets of multiplicative factors (e.g., a first set of multiplicative factors 153 and a second set of multiplicative factors 155) to the digital signals 133, 135, 137, 139 if the position information 141 indicates that each microphone 112, 114, 116, 118 is positioned within the cubic space. Alternatively, the directivity adjuster activation unit 144 may determine to apply more than two sets of multiplicative factors (e.g., four sets, eights sets, etc.) to the digital signals 133, 135, 137, 139 if the position information 141 indicates that each microphone 112, 114, 116, 118 is not positioned within the particular dimensions. Although described above with respect to the position information, the directivity adjuster activation unit 144 may also determine how many sets of multiplicative factors are to be applied to the digital signals 133, 135, 137, 139 based on the orientation information, the power level information 143, other information associated with the microphones 112, 114, 116, 118, or a combination thereof.

The method 900 compensates for flexible microphone positions (e.g., a "non-ideal" tetrahedral microphone arrangement) by adjusting a number of active directivity adjusters, filters, multiplicative factors, and filter coefficients based on the position of the microphones, the orientation of the microphones, etc.

Figure 10:
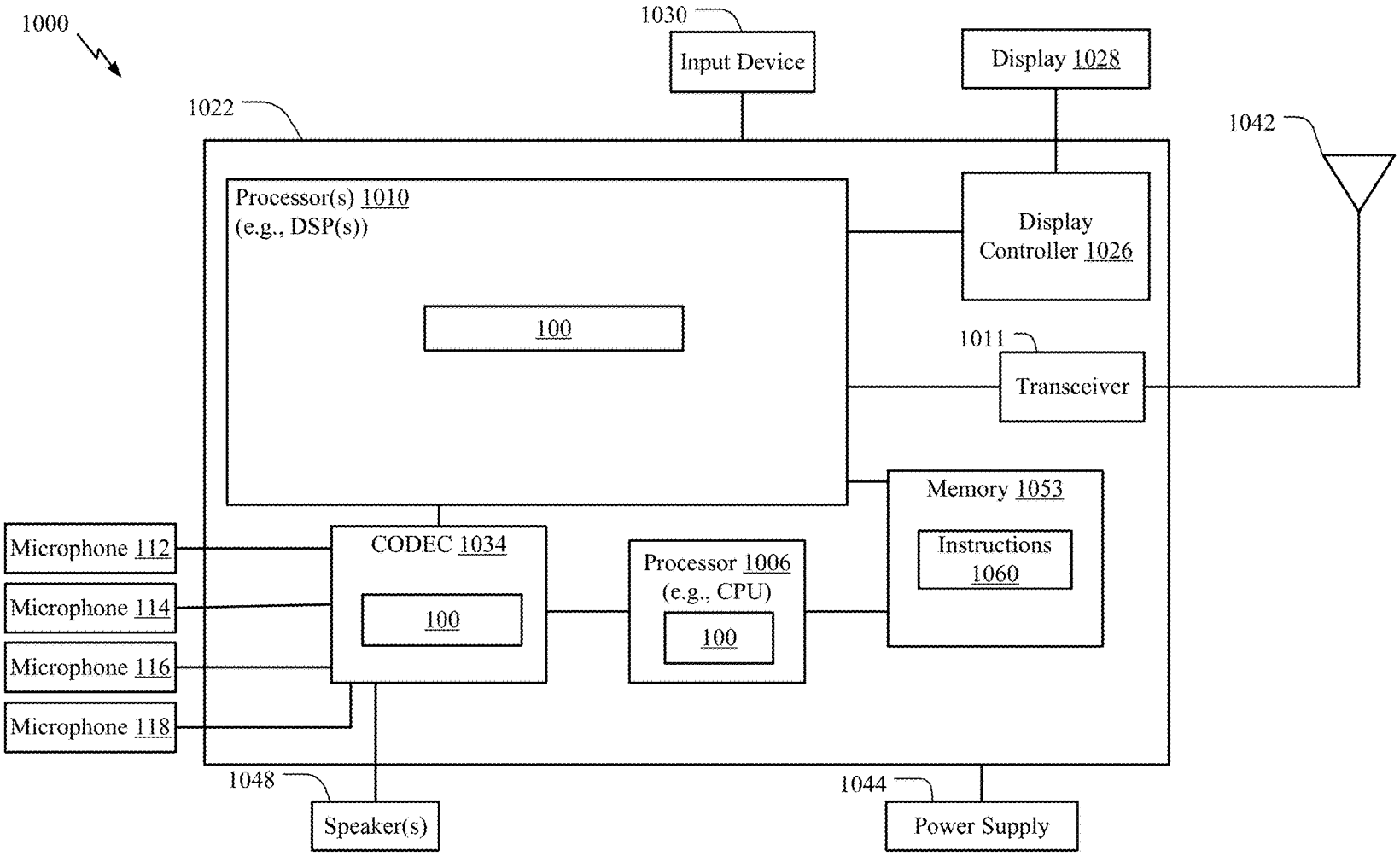
FIG. 10 is a block diagram of a particular illustrative example of a mobile device that is operable to perform the techniques described with reference to FIGS. 1A-9.

Referring to FIG. 10, a block diagram of a particular illustrative implementation of a device (e.g., a wireless communication device) is depicted and generally designated 1000. In various implementations, the device 1000 may have more components or fewer components than illustrated in FIG. 10.

In a particular implementation, the device 1000 includes a processor 1006, such as a central processing unit (CPU) or a digital signal processor (DSP), coupled to a memory 1053. The memory 1053 includes instructions 1060 (e.g., executable instructions) such as computer-readable instructions or processor-readable instructions. The instructions 1060 may include one or more instructions that are executable by a computer, such as the processor 1006 or a processor 1010.

FIG. 10 also illustrates a display controller 1026 that is coupled to the processor 1010 and to a display 1028. A coder/decoder (CODEC) 1034 may also be coupled to the processor 1006. A speaker 1036 and the microphones 112, 114, 116, 118 may be coupled to the CODEC 1034. The CODEC 1034 includes other components of the system 100 (e.g., the signal processors 120, 122, 124, 126, the microphone analyzer 140, the directivity adjusters 150, the filters 170, the combination circuits 195-198, etc.). In other implementations, the processors 1006, 1010 may include the components of the system 100.

A transceiver 1011 may be coupled to the processor 1010 and to an antenna 1042, such that wireless data received via the antenna 1042 and the transceiver 1011 may be provided to the processor 1010. In some implementations, the processor 1010, the display controller 1026, the memory 1053, the CODEC 1034, and the transceiver 1011 are included in a system-in-package or system-on-chip device 1022. In some implementations, an input device 1030 and a power supply 1044 are coupled to the system-on-chip device 1022. Moreover, in a particular implementation, as illustrated in FIG. 10, the display 1028, the input device 1030, the speaker 1036, the microphones 112, 114, 116, 118, the antenna 1042, and the power supply 1044 are external to the system-on-chip device 1022. In a particular implementation, each of the display 1028, the input device 1030, the speaker 1036, the microphones 112, 114, 116, 118, the antenna 1042, and the power supply 1044 may be coupled to a component of the system-on-chip device 1022, such as an interface or a controller.

The device 1000 may include a headset, a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, a navigation device, a vehicle, a component of a vehicle, or any combination thereof, as illustrative, non-limiting examples.

In an illustrative implementation, the memory 1053 may include or correspond to a non-transitory computer readable medium storing the instructions 1060. The instructions 1060 may include one or more instructions that are executable by a computer, such as the processors 1010, 1006 or the CODEC 1034. The instructions 1060 may cause the processor 1010 to perform one or more operations described herein, including but not limited to one or more portions of the methods 800, 810 900 of FIGS. 8A-9.

In a particular implementation, one or more components of the systems and devices disclosed herein may be integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

In conjunction with the described techniques, a first apparatus includes means for performing signal processing operations on signals captured by each microphone of a microphone array. For example, the means for performing may include the signal processors 120, 122, 124, 126 of FIG. 1B, the analog-to-digital converters 121, 123, 125, 127 of FIG. 1B, the processors 1006, 1008 of FIG. 10, the CODEC 1034 of FIG. 10, the instructions 1060 executable by a processor, one or more other devices, circuits, or any combination thereof.

The first apparatus also includes means for performing a first directivity adjustment by applying a first set of multiplicative factors to the signals to generate a first set of ambisonic signals. The first set of multiplicative factors is determined based on a position of each microphone in the microphone array, an orientation of each microphone in the microphone array, or both. For example, the means for performing the first directivity adjustment may include the directivity adjuster 154 of FIG. 1B, the directivity adjuster and corresponding filters 602 of FIG. 6A, the processors 1006, 1008 of FIG. 10, the CODEC 1034 of FIG. 10, the instructions 1060 executable by a processor, one or more other devices, circuits, or any combination thereof.

The first apparatus also includes means for performing a second directivity adjustment by applying a second set of multiplicative factors to the signals to generate a second set of ambisonic signals. The second set of multiplicative factors is determined based on the position of each microphone in the microphone array, the orientation of each microphone in the microphone array, or both. For example, the means for performing the second directivity adjustment may include the directivity adjuster 152 of FIG. 1B, the directivity adjuster and corresponding filters 604 of FIG. 6A, the processors 1006, 1008 of FIG. 10, the CODEC 1034 of FIG. 10, the instructions 1060 executable by a processor, one or more other devices, circuits, or any combination thereof.

In conjunction with the described techniques, a second apparatus includes means for determining position information for each microphone of a microphone array. The microphone array includes a first microphone, a second microphone, a third microphone, and a fourth microphone. At least two microphones associated with the microphone array are located on different two-dimensional planes. For example, the means for determining the position information may include the microphone analyzer 140 of FIG. 1B, the processors 1006, 1008 of FIG. 10, the CODEC 1034 of FIG. 10, the instructions 1060 executable by a processor, one or more other devices, circuits, or any combination thereof.

The second apparatus also includes means for determining orientation information for each microphone of the microphone array. For example, the means for determining the orientation information may include the microphone analyzer 140 of FIG. 1B, the processors 1006, 1008 of FIG. 10, the CODEC 1034 of FIG. 10, the instructions 1060 executable by a processor, one or more other devices, circuits, or any combination thereof.

The second apparatus also includes means for determining how many sets of multiplicative factors are to be applied to digital signals associated with microphones of the microphone array based on the position information and the orientation information. Each set of multiplicative factors is used to determine a processed set of ambisonic signals. For example, the means for determining how many sets of multiplicative factors are to be applied may include the microphone analyzer 140 of FIG. 1B, the directivity adjuster activation unit 144 of FIG. 1B, the processors 1006, 1008 of FIG. 10, the CODEC 1034 of FIG. 10, the instructions 1060 executable by a processor, one or more other devices, circuits, or any combination thereof.

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed includes an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.).

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm.

Another exemplary audio acquisition context may include a production truck which may be configured to receive a signal from one or more microphones, such as one or more Eigen microphones. The production truck may also include an audio encoder.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

It should be noted that various functions performed by the one or more components of the systems and devices disclosed herein are described as being performed by certain components. This division of components is for illustration only. In an alternate implementation, a function performed by a particular component may be divided amongst multiple components. Moreover, in an alternate implementation, two or more components may be integrated into a single component or module. Each component may be implemented using hardware (e.g., a field-programmable gate array (FPGA) device, an application-specific integrated circuit (ASIC), a DSP, a controller, etc.), software (e.g., instructions executable by a processor), or any combination thereof.

Those of skill would further appreciate that the various illustrative logical blocks, configurations, circuits, and algorithm steps described in connection with the implementations disclosed herein may be implemented as electronic hardware, computer software executed by a processing device such as a hardware processor, or combinations of both. Various illustrative components, blocks, configurations, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. An apparatus comprising:

a processor configured to:

perform signal processing operations on signals captured by each microphone in a microphone array; and perform a first directivity adjustment by applying a first set of multiplicative factors to the signals to generate a first set of ambisonic signals, the first set of multiplicative factors determined based on a position of each microphone in the microphone array, an orientation of each microphone in the microphone array, or both.

2. The apparatus of claim 1, wherein the processor is further configured to:

perform a second directivity adjustment by applying a second set of multiplicative factors to the signals to generate a second set of ambisonic signals, the second set of multiplicative factors determined based on the position of each microphone in the microphone array, the orientation of each microphone in the microphone array, or both.

3. The apparatus of claim 1, further comprising the microphone array, the microphone array comprising a first microphone, a second microphone, a third microphone, and a fourth microphone, at least two microphones associated with the microphone array located on different two-dimensional planes.

4. The apparatus of claim 1, further comprising a basis function selector integrated into the processor, the basis function selector configured to select at least one basis function for the first directivity adjustment.

5. The apparatus of claim 4, further comprising one or more cameras coupled to the processor, the one or more cameras configured to capture one or more areas of interest surrounding the microphone array, wherein the at least one basis function is selected based on corresponding probabilities of audio activity in the one or more areas of interest.

6. The apparatus of claim 4, wherein the at least one basis function is selected in response to a user input.

7. The apparatus of claim 4, further comprising an error detection unit coupled to the basis function selector.

8. The apparatus of claim 7, further comprising an adjustment unit coupled to the error detection unit, the adjustment unit configured to, based on an error detected by the error detection unit, adjust the first set of multiplicative factors.

9. The apparatus of claim 1, further comprising an optical wearable, wherein microphone array is integrated into the optical wearable.

10. The apparatus of claim 1, further comprising a laptop, wherein the microphone array is integrated into the laptop.

11. The apparatus of claim 1, further comprising a camera, wherein the microphone array is integrated into the camera.

12. The apparatus of claim 1, further comprising an augmented reality headset, wherein the microphone array is integrated into the augmented reality headset.

13. The apparatus of claim 1, further comprising:

a first set of filters coupled integrated into the processor, the first set of filters configured to filter the first set of ambisonic signals to generate a filtered first set of ambisonic signals, the first set of filters having first filter coefficients that are based on the position of each microphone in the microphone array, the orientation of each microphone in the microphone array, or both.

14. The apparatus of claim 13, further comprising combination circuitry coupled to the first set of filters and to a second set of filters, the combination circuitry configured to combine the filtered first set of ambisonic signals and a filtered second set of ambisonic signals associated with the second set of filters to generate a processed set of ambisonic signals.

15. The apparatus of claim 14, wherein the processed set of ambisonic signals corresponds to a set of first order ambisonic signals including a W signal, an X signal, a Y signal, and a Z signal.

16. The apparatus of claim 1, wherein each microphone in the microphone array is positioned within a cubic space having particular dimensions, and wherein a number of directivity adjustments performed is based on the particular dimensions.

17. The apparatus of claim 16, wherein the particular dimensions are defined by a two centimeter length, a two centimeter width, and a two centimeter height.

18. The apparatus of claim 1, wherein the processor is configured to apply the first set of multiplicative factors to the signals using a first matrix multiplication.

19. The apparatus of claim 1, wherein the first set of multiplicative factors is further determined based on a power level of each microphone in the microphone array.

20. A method comprising:

performing, at a processor, signal processing operations on signals captured by each microphone in a microphone array; and performing a first directivity adjustment by applying a first set of multiplicative factors to the signals to generate a first set of ambisonic signals, the first set of multiplicative factors determined based on a position of each microphone in the microphone array, an orientation of each microphone in the microphone array, or both.

21. The method of claim 20, further comprising:

performing a second directivity adjustment by applying a second set of multiplicative factors to the signals to generate a second set of ambisonic signals, the second set of multiplicative factors determined based on the position of each microphone in the microphone array, the orientation of each microphone in the microphone array, or both.

22. The method of claim 20, further comprising:

capturing one or more areas of interest surrounding the microphone array using one or more cameras;

selecting a basis function for the first directivity adjustment based on corresponding probabilities of audio activity in the one or more areas of interest.

23. The method of claim 22, further comprising selecting a different basis function for the first directivity adjustment in response to a determination that the corresponding probabilities of audio activity in the one or more areas of interest has changed.

24. The method of claim 20, wherein each microphone in the microphone array is positioned within a cubic space having particular dimensions, and wherein a number of directivity adjusters used to process the signals is based on the particular dimensions.

25. The method of claim 24, wherein the particular dimensions are defined by a two centimeter length, a two centimeter width, and a two centimeter height.

26. The method of claim 20, wherein the microphone array comprises at least three microphones located in non-ideal tetrahedron microphone positions.

27. A non-transitory computer-readable medium comprising instructions that, when executed by a processor, cause the processor to perform operations comprising:

performing signal processing operations on signals captured by each microphone in a microphone array; and performing a first directivity adjustment by applying a first set of multiplicative factors to the signals to generate a first set of ambisonic signals, the first set of multiplicative factors determined based on a position of each microphone in the microphone array, an orientation of each microphone in the microphone array, or both.

28. The non-transitory computer-readable medium of claim 27, wherein the operations further comprise:

performing a second directivity adjustment by applying a second set of multiplicative factors to the signals to generate a second set of ambisonic signals, the second set of multiplicative factors determined based on the position of each microphone in the microphone array, the orientation of each microphone in the microphone array, or both.

29. An apparatus comprising:

means for performing signal processing operations on signals captured by each microphone in a microphone array; and means for performing a first directivity adjustment by applying a first set of multiplicative factors to the signals to generate a first set of ambisonic signals, the first set of multiplicative factors determined based on a position of each microphone in the microphone array, an orientation of each microphone in the microphone array, or both.

30. The apparatus of claim 29, further comprising:

means for performing a second directivity adjustment by applying a second set of multiplicative factors to the signals to generate a second set of ambisonic signals, the second set of multiplicative factors determined based on the position of each microphone in the microphone array, the orientation of each microphone in the microphone array, or both.

* * * * *